US011103119B2

(12) United States Patent
Hong et al.

(10) Patent No.: US 11,103,119 B2
(45) Date of Patent: Aug. 31, 2021

(54) DISHWASHING MACHINE AND METHOD OF CONTROLLING THE SAME

(71) Applicant: Samsung Electronics Co., Ltd, Suwon-si (KR)

(72) Inventors: Eun-Kyung Hong, Anyang-si (KR); Da Nim Kang, Anyang-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 59 days.

(21) Appl. No.: 15/051,415

(22) Filed: Feb. 23, 2016

(65) Prior Publication Data

US 2016/0242619 A1 Aug. 25, 2016

(30) Foreign Application Priority Data

Feb. 23, 2015 (KR) ..... 10-2015-0024887

(51) Int. Cl.

| | |
|---|---|
| ***A47L 15/42*** | (2006.01) |
| ***A47L 15/00*** | (2006.01) |
| ***A47L 15/16*** | (2006.01) |
| ***A47L 15/23*** | (2006.01) |

(52) U.S. Cl.

CPC ..... *A47L 15/4221* (2013.01); *A47L 15/0028* (2013.01); *A47L 15/16* (2013.01); *A47L 15/23* (2013.01); *A47L 15/4282* (2013.01); *A47L 15/4289* (2013.01); *A47L 15/4293* (2013.01); *A47L 2301/04* (2013.01); *A47L 2301/06* (2013.01); *A47L 2301/08* (2013.01); *A47L 2501/03* (2013.01); *A47L 2501/04* (2013.01); *A47L 2501/20* (2013.01)

(58) Field of Classification Search

None

See application file for complete search history.

(56) References Cited

U.S. PATENT DOCUMENTS

| | | | | |
|---|---|---|---|---|
| 2,236,791 | A * | 4/1941 | Forsberg | A47L 15/18 134/172 |
| 6,858,595 | B2 | 2/2005 | Hayes et al. | |
| 10,188,261 | B2 | 1/2019 | Hong et al. | |

(Continued)

FOREIGN PATENT DOCUMENTS

| | | | |
|---|---|---|---|
| CN | 1682646 | A | 10/2005 |
| CN | 104095600 | A | 10/2014 |

(Continued)

OTHER PUBLICATIONS

Extended European Search Report dated Jul. 8, 2016 in connection with European Application No. 16156753.2, 10 pages.

(Continued)

*Primary Examiner* — Mikhail Kornakov
*Assistant Examiner* — Pradhuman Parihar

(57) ABSTRACT

According to one embodiment of the present disclosure, a dishwashing machine includes a tub accommodating tableware, a nozzle assembly spraying washing water, a vane assembly changing a traveling direction of the washing water sprayed from the nozzle assembly to move linearly inside the tub, a user interface for receiving a divided washing zone selected by a user, and a control unit controlling movement of the vane assembly to wash the selected divided zone by the washing water including the changed traveling direction.

20 Claims, 36 Drawing Sheets

(56) References Cited

U.S. PATENT DOCUMENTS

| | | | | |
|---|---|---|---|---|
| 2009/0056754 | A1* | 3/2009 | Rolek | A47L 15/0018 134/18 |
| 2012/0031432 | A1* | 2/2012 | Beaudet | A47L 15/0021 134/18 |
| 2013/0319487 | A1* | 12/2013 | Hong | A47L 15/06 134/183 |
| 2015/0053237 | A1* | 2/2015 | Lee | A47L 15/4295 134/18 |
| 2015/0128999 | A1* | 5/2015 | Park | A47L 15/16 134/25.2 |

FOREIGN PATENT DOCUMENTS

| | | | | |
|---|---|---|---|---|
| CN | 104173010 | A | 12/2014 | |
| CN | 105899114 | A | 8/2016 | |
| DE | 29607515 | U1 | 8/1997 | |
| EP | 0717953 | A1 * | 6/1996 | A47L 15/4295 |
| EP | 2181636 | A1 | 5/2010 | |
| EP | 2786691 | A2 | 10/2014 | |
| KR | 10-2014-0121765 | A | 10/2014 | |
| WO | 2011158270 | A2 | 12/2011 | |
| WO | WO 2015/068990 | A1 | 5/2015 | |

OTHER PUBLICATIONS

European Patent Office Communication pursuant to Article 94(3) EPC regarding Application No. 16156753.2, dated Mar. 1, 2019, 4 pages.

China National Intellectual Property Administration, "The First Office Action," Application No. CN201610098406.7, dated Aug. 23, 2019, 29 pages.

European Patent Office, "Communication pursuant to Article 94(3) EPC," Application No. EP16156753.2, dated Apr. 7, 2017, 7 pages, EPO, Munich, Germany.

Lowe's, BSH Home Appliances Corporation, Bosch Diswashers, https://www.lowes.com/brands/Bosch/pdf/Dishwasher_Printable_Mini-Brochure.pdf, 2012, 44 pages.

Warners' Stellian via Wayback Machine, "What types of speciality cycles are there, and how do they work?", http://web.archive.org/web/20121116152411/http://www.warnerstellian.com/dishwasher-buying-guide, Nov. 11, 2012, 2 pages.

Office Action dated Jul. 9, 2020 in connection with Chinese Patent Application No. 201610098406.7, 23 pages.

Notice of Preliminary Rejection dated Apr. 13, 2021 in connection with Korean Patent Application No. 10-2015-0024887, 25 pages.

* cited by examiner

DISHWASHING MACHINE AND METHOD OF CONTROLLING THE SAME

CROSS-REFERENCE TO RELATED APPLICATION(S) AND CLAIM OF PRIORITY

The present application is related to and claims the benefit of Korean Patent Application No. 10-2015-0024887, filed on Feb. 23, 2015 in the Korean Intellectual Property Office, the disclosure of which is incorporated herein by reference.

TECHNICAL FIELD

The present disclosure relates to a dishwashing machine for washing tableware by spraying washing water and a method of controlling the same.

BACKGROUND

A dishwashing machine is a machine for washing tableware by spraying the tableware with washing water at a high pressure, and generally performs a washing process and a rinsing process. The tableware is cleaned by spraying washing water simultaneously supplying detergent using a detergent supply device in the washing process, and spraying only washing water in the rinsing process.

A rotary type dishwashing machine includes a rotary spray unit. The rotary spray unit is provided as a rotatable structure inside a tub to spray washing water while rotating in reaction to the sprayed washing water.

Since the rotary type dishwashing machine sprays the washing water while rotating, a region to be washed may not be freely selected and different washing courses for each region may not be selected.

SUMMARY

To address the above-discussed deficiencies, it is a primary object to provide, for use in a dishwashing machine and a method of controlling the same capable of selecting a washing zone to be washed in divided washing are provided.

According to an aspect of the present disclosure, a dishwashing machine includes a tub configured to accommodate tableware, a nozzle assembly configured to spray washing water, a vane assembly configured to change a traveling direction of the washing water sprayed from the nozzle assembly and to move linearly inside the tub, a user interface configured to receive a divided washing zone selected by a user, and a control unit configured to control movement of the vane assembly to wash the selected divided zone with the washing water including the changed traveling direction.

Also, the user interface may include a washing zone selection unit configured to select the divided washing zone, and a washing course selection unit configured to select a washing method of the divided washing zone.

Further the washing zone selection unit may include a first indicator configured to display selected divided washing zones among the divided washing zones, and the washing course selection unit may include a second indicator configured to display a washing method selected from a plurality of washing methods.

Furthermore, the user interface may include a display configured to display the washing course set for each of the divided washing zones.

Also, the user interface may display a zone selection screen configured to select the divided washing zone.

Further, the user interface may display a washing course selection screen configured to determine a washing method of the selected divided washing zone after selecting the divided washing zone. At this point, the zone selection screen may discriminate a predetermined divided washing zone from a selectable divided washing zone to display the predetermined divided washing zone and the selectable divided washing zone.

Furthermore, the control unit may determine a linear movement range of the vane assembly according to the divided washing zone, and control a movement speed of the vane assembly according to the selected washing method of the divided washing zone.

Also, the nozzle assembly may include a plurality of nozzles, and the control unit controls distribution of the washing water to spray the washing water from nozzles corresponding to the divided washing zone among the nozzles.

Further, the control unit may control a spray pressure of the washing water according to the selected washing method of the washing zone.

According to another aspect of the present disclosure, a method of controlling a dishwashing machine, which includes a tub configured to accommodate tableware, a nozzle assembly configured to spray washing water, a vane assembly configured to change a traveling direction of the washing water sprayed from the nozzle assembly and to move linearly inside the tub, and a user interface, includes the steps of setting a divided washing zone to be washed by receiving the divided washing zone input by a user through the user interface; and washing the divided washing zone by moving the vane assembly and using the washing water including the changed traveling direction.

Also, the setting may include selecting a washing method of the input divided washing zone.

Further, the setting may include displaying the input washing zone among a plurality of washing zones.

Furthermore, the setting may include displaying the selected washing method among a plurality of washing methods.

Also, the setting may include displaying a washing course selected with respect to each of the washing zones.

Further, the setting may include displaying a zone selection screen configured to select the washing zone. At this point, a washing course selection screen configured to determine a washing method of a washing zone after the washing zone is selected may be displayed.

Furthermore, the washing may include distributing the washing water according to the divided washing zone and the washing method, and controlling movement of the vane assembly according to the divided washing zone and the washing method.

According to aspects of the present disclosure disclosed herein, the efficiency of tableware washing may be improved and a washing time may be reduced by divided a washing zone and performing washing.

Also, according to aspects of the present disclosure disclosed herein, a user can freely select a washing zone to be washed in divided washing, and thus the usage convenience of a dishwashing machine may be improved.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely. Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

FIGS. 1 through 33, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged device. Hereinafter, embodiments of the present disclosure will be described in detail with reference to the accompanying drawings.

Figure 1:
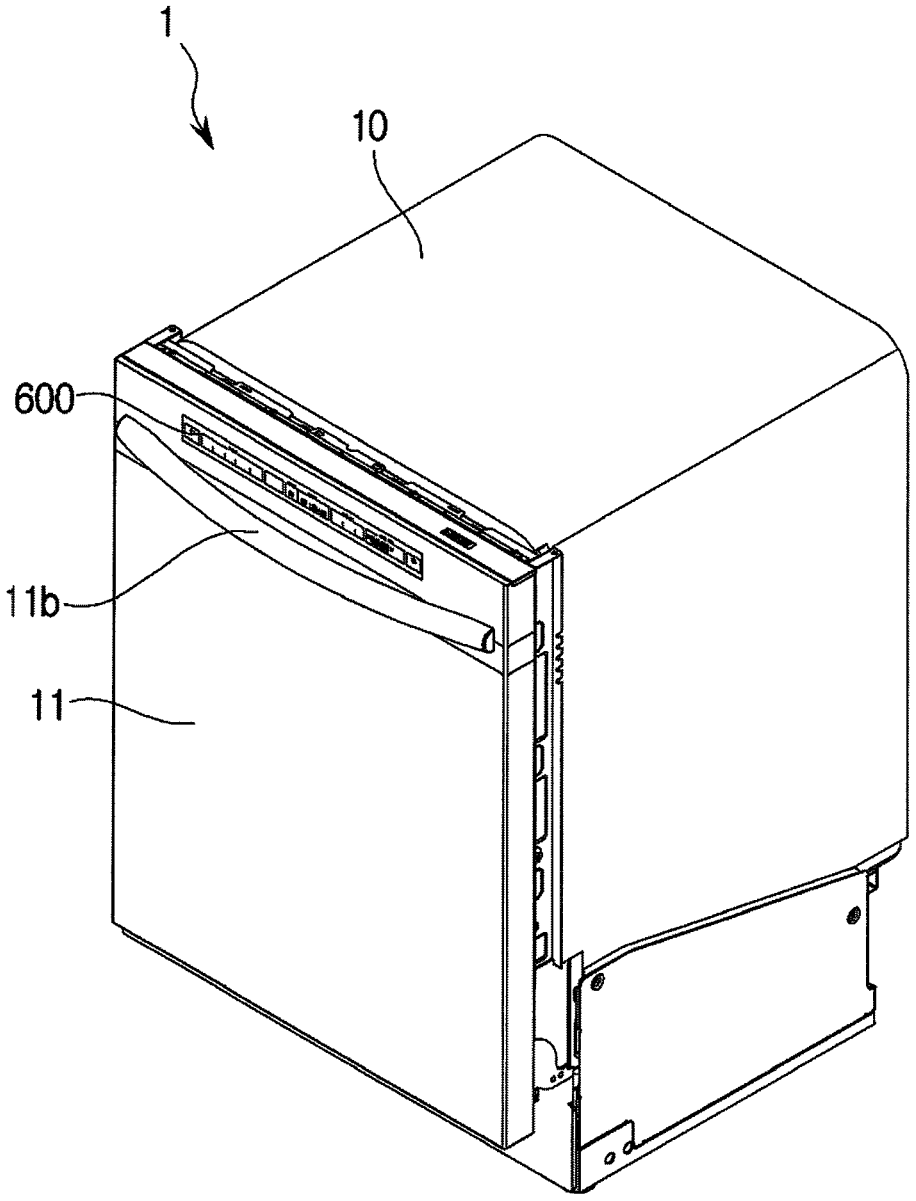
FIG. 1 illustrates a dishwashing machine according to various embodiments of the present disclosure.
Figure 2:
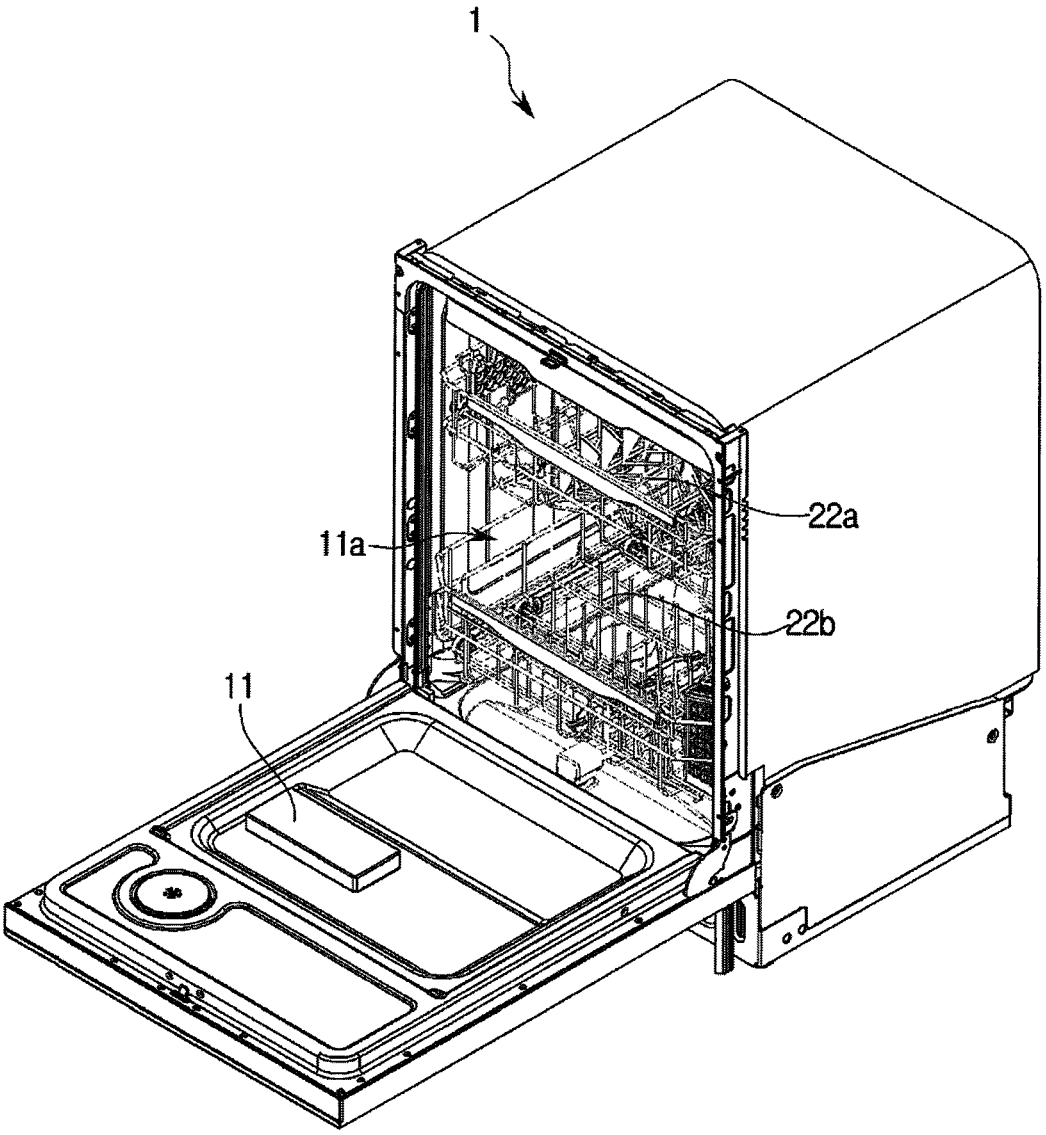
FIG. 2 illustrates an opening state of a door of the dishwashing machine according to various embodiments of the present disclosure.
Figure 3:
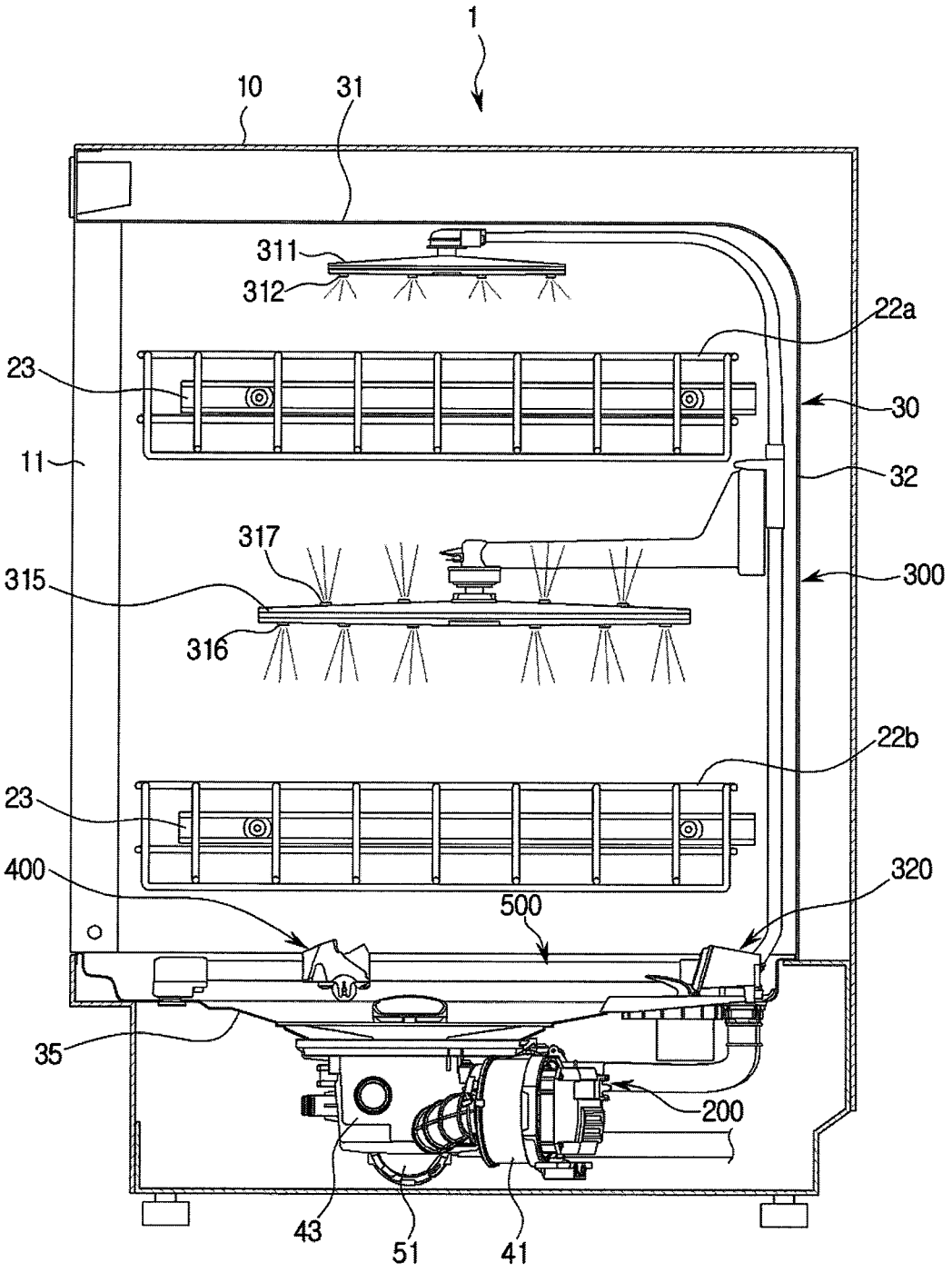
FIG. 3 illustrates a schematic cross-sectional view of the dishwashing machine according to various embodiments of the present disclosure.

With reference to FIGS. 1 to 3, an overall structure of a dishwashing machine according to one embodiment of the present disclosure will be described in general.

FIG. 1 is a perspective view of the dishwashing machine according to one embodiment, FIG. 2 is a perspective view illustrating an open state of a door of the dishwashing machine according to one embodiment, and FIG. 3 is a schematic cross-sectional view of the dishwashing machine according to one embodiment.

With reference to FIGS. 1 and 2, a dishwashing machine 1 may include a main body 10 constituting an exterior and provided with a tub 30 therein. As shown in FIG. 1, the main body 10 may be made in the form of a box shape. However, the main body 10 is not limited to the shape illustrated in FIG. 1, but may be made in the form of a cylindrical or polyhedral shape, or a polygonal box shape other than a hexahedral shape. In addition, the dishwashing machine 1 may be made in a variety of shapes applicable to the exterior thereof.

A user interface 600 may be provided on an outside surface of the main body 10. The user interface 600 receives a control instruction of a user and outputs an electrical signal corresponding to the received control instruction. The user interface 600 may include at least one input means among a keyboard, a mouse, a track-ball, a touch screen, a touch pad, a pedal, a variety of levers or handles, a joystick, and various other input means, and at least one display means among a plasma display panel (PDP), a light emitting diode (LED), an organic light emitting diode (OLED), a liquid crystal display (LCD), a seven-segment display, and/or various other display means for displaying a variety of information related to the driving of the dishwashing machine 1. In the following description, exemplary embodiments of the user interface 600 will be described in detail.

A door 11 through which tableware can be put in and taken out may be provided on one surface of the main body 10. As shown in FIG. 2, the door 11 may be opened and closed by being moved in a predetermined direction. According to one embodiment, a hinge for rotationally moving a body of the door 11 in the predetermined direction may be provided on one end of the door 11. According to another embodiment, the door 11 may be opened and closed in a sliding manner. The door 11 may be provided on a front of an opening 11*a* of the tub 30, and a user may store tableware inside the tub 30 through the opening 11*a*. A handle 11*b* may be provided on the door 11 in order to enable the user to easily open and close the door 11.

Figure 4:
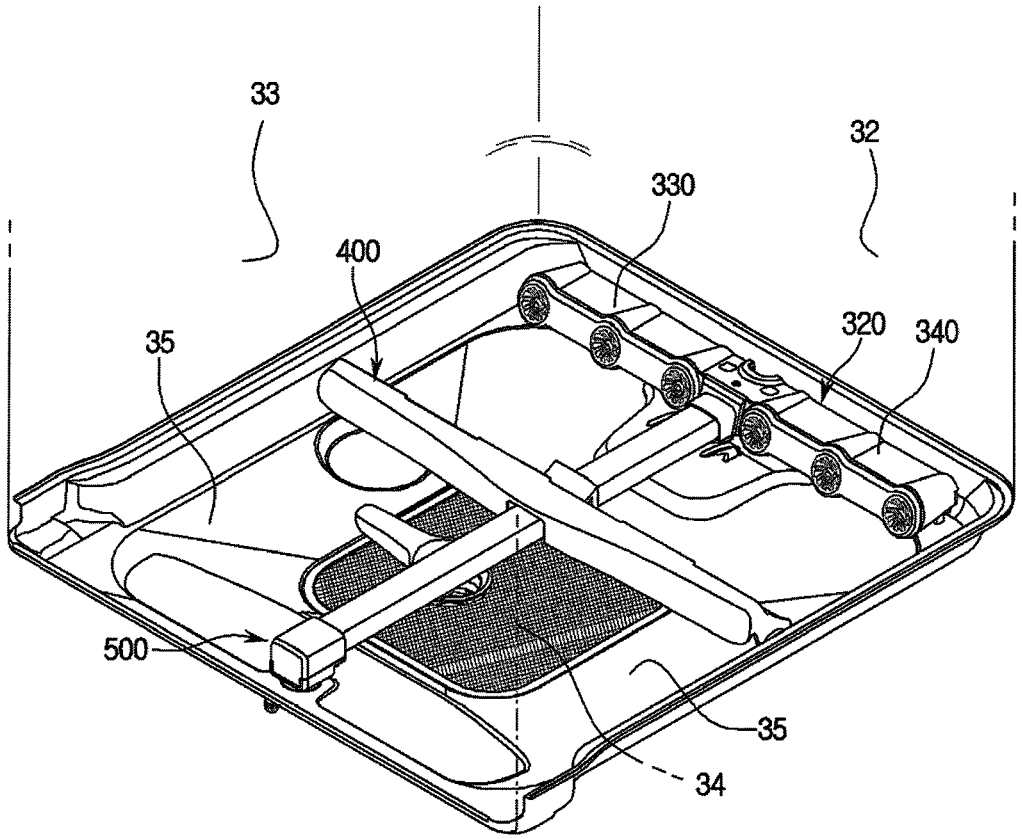
FIG. 4 illustrates a bottom portion of the dishwashing machine according to various embodiments of the present disclosure.
Figure 5:
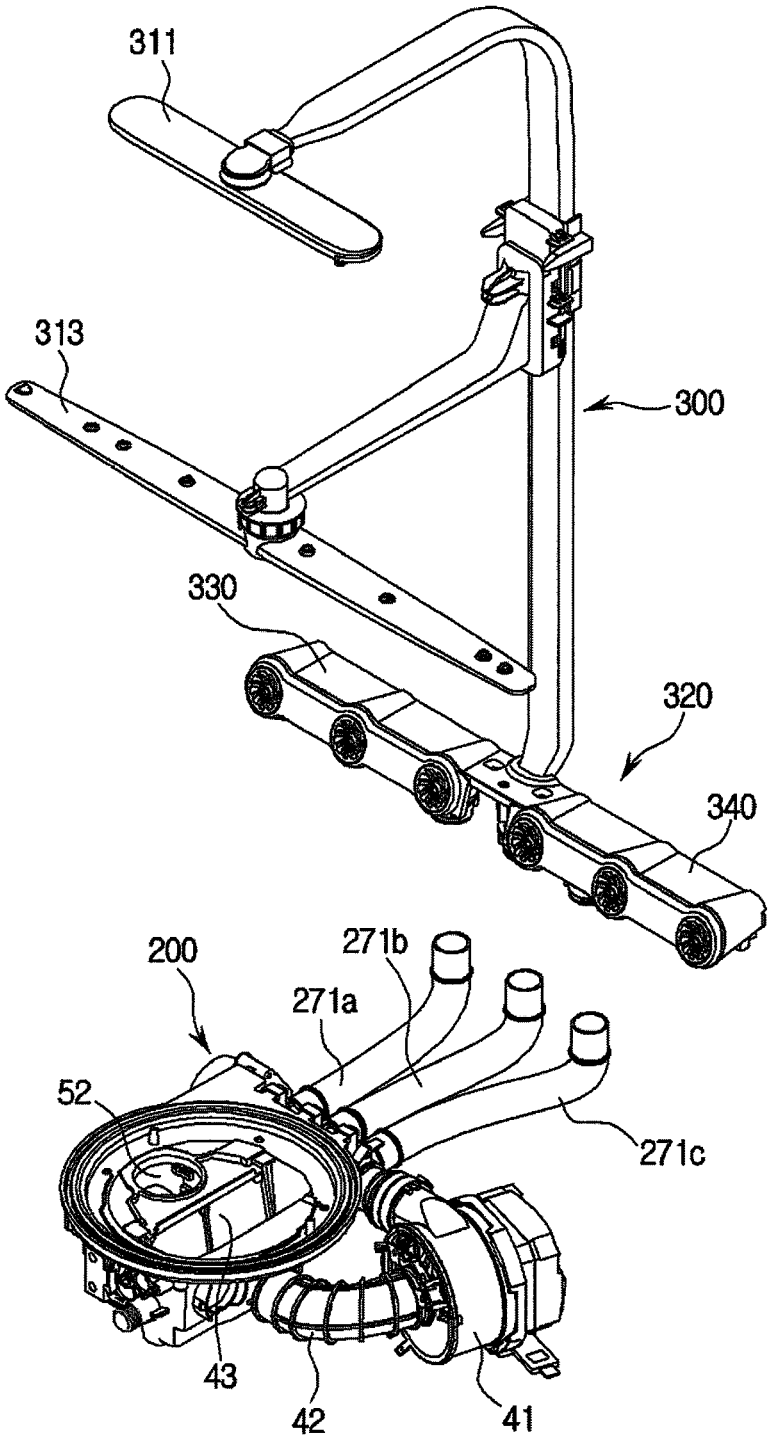
FIG. 5 illustrates major components of the dishwashing machine according to various embodiments of the present disclosure.
Figure 6:
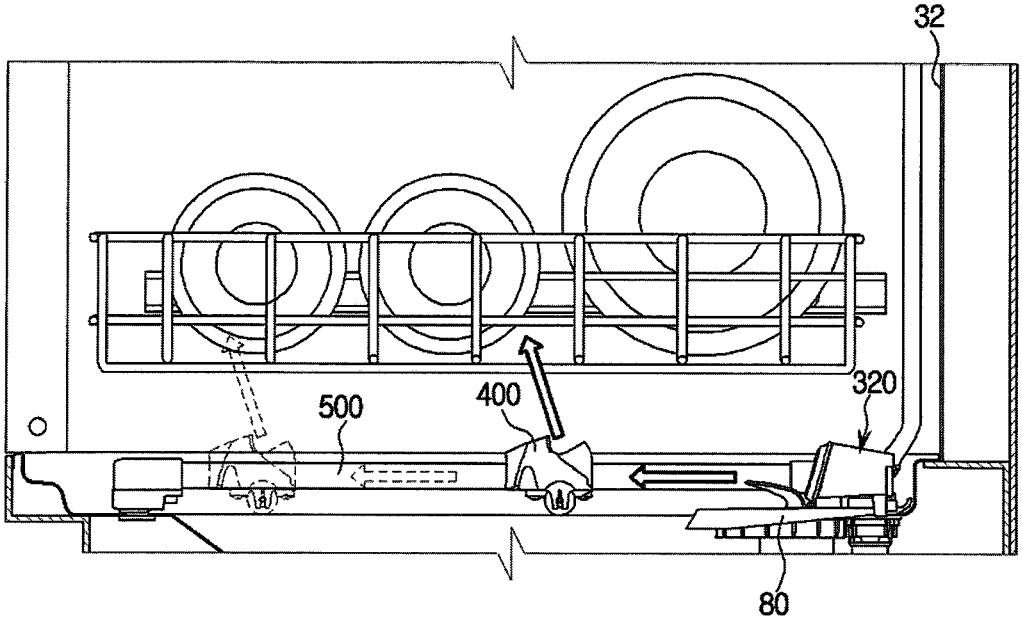
FIG. 6 illustrates an operation of a vane assembly of the dishwashing machine according to various embodiments of the present disclosure.

FIG. 4 is a diagram schematically illustrating a bottom portion of the dishwashing machine according to one embodiment, FIG. 5 is a diagram illustrating major components of the dishwashing machine according to one embodiment, and FIG. 6 is a diagram for explaining an operation of a vane assembly of the dishwashing machine according to one embodiment.

With reference to FIGS. 2 to 5, the tub 30 in which the tableware is washed and a sump 43 on which washing water with which the tableware has been cleaned is accommodated are included inside the main body 10.

The opening 11*a* through which the tableware can be put in and taken out in at least one direction may be provided on one surface of the tub 30. The opening 11*a* may be opened and closed by the door 11.

Also, the tub 30 may be equipped with multiple walls 31 to 34 and a bottom plate 35. The bottom plate 35 is disposed in a downward direction or on a lower portion of the tub 30, and the upper wall 31 is disposed at a position opposite to the bottom plate 35. The rear wall 32 is disposed at a position opposite to the opening 11*a*, and the left wall 33 and the right wall 34 are respectively disposed at left and right sides viewed from the opening 11*a*.

Hereinafter, for convenience of explanation, a direction in which the opening 11*a* is placed will be referred to as a front direction, and a direction opposite to the front direction will be referred to as a rear direction.

Accommodation racks 22*a* and 22*b* on which the tableware is held may be provided inside the tub 30. The accommodation racks 22*a* and 22*b* may be provided in the form of a basket to accommodate the tableware. The basket may be a wire rack that is made of wires to enable the washing water to pass therethrough without stagnating. The accommodation racks 22*a* and 22*b* may include the upper accommodation rack 22*a* disposed at an upper portion of the tub 30 and the lower accommodation rack 22*b* disposed at a lower portion of the tub 30.

Also, the accommodation racks 22*a* and 22*b* may be attached to and detached from the tub 30. The accommodation racks 22*a* and 22*b* are capable of moving forward and backward on slide rails 23 provided inside the tub 30. Therefore, the user may put the tableware in and take it out by drawing the accommodation racks 22*a* and 22*b* out in the front direction of the main body 10. Alternatively, the forward and backward movement of the accommodation racks 22*a* and 22*b* may be performed in an automatic manner.

A nozzle assembly 300 sprays the washing water at a high pressure in order to wash the tableware. In particular, the nozzle assembly 300 may include an upper nozzle 311 provided in an upper portion of the tub 30, a center nozzle 315 provided in the center of the tub 30, and a fixed nozzle 320 provided at the lower end of the tub 30.

The upper nozzle 311 sprays the washing water through first spray holes 312 formed in the lower direction in the tub 30. The upper nozzle 311 may rotate in reaction to the sprayed washing water.

The center nozzle 315 includes second spray holes 317 formed in the upper direction and third spray holes 316 formed in the lower direction. The washing water is sprayed in the upper direction through the second spray holes 317 and in the lower direction through the third spray holes 316. Therefore, the center nozzle 315 may rotate in reaction to the sprayed washing water.

The fixed nozzle 320 is fastened to the lower portion of the tub 30. Unlike the upper nozzle 311 and the center nozzle 315, the fixed nozzle 320 may be immovably fastened to one side of the tub 30.

Also, the fixed nozzle 320 may be arranged adjacent to the rear wall 32 of the tub 30 to spray the washing water toward the front of the tub 30. The washing water sprayed from the fixed nozzle 320 may not be directed at the tableware.

Further, the fixed nozzle 320 may include a left nozzle 330 arranged on the left side of the tub 30 and a right nozzle 340 disposed on the right side of the tub 30.

A vane assembly 400 may alter a traveling direction of the washing water by deflecting the washing water sprayed from the fixed nozzle 320. For this purpose, the vane assembly 400 may extend widthwise in left and right directions of the tub 30.

A vane drive assembly 500 moves the vane assembly 400. The vane drive assembly 500 may cause the vane assembly 400 to perform a rectilinear reciprocating motion along the traveling direction of the washing water sprayed from the fixed nozzle 320. That is, as shown in FIG. 6, the vane assembly 400 deflects the washing water sprayed from the fixed nozzle 320 in the direction of the tableware while moving the front and rear directions of the tub 30, and thereby all zones of the tub 30 can be cleaned with no dead zones.

Hereinafter, the vane assembly and the vane drive assembly will be described in detail with reference to FIGS. 7 to 9.

Figure 7:
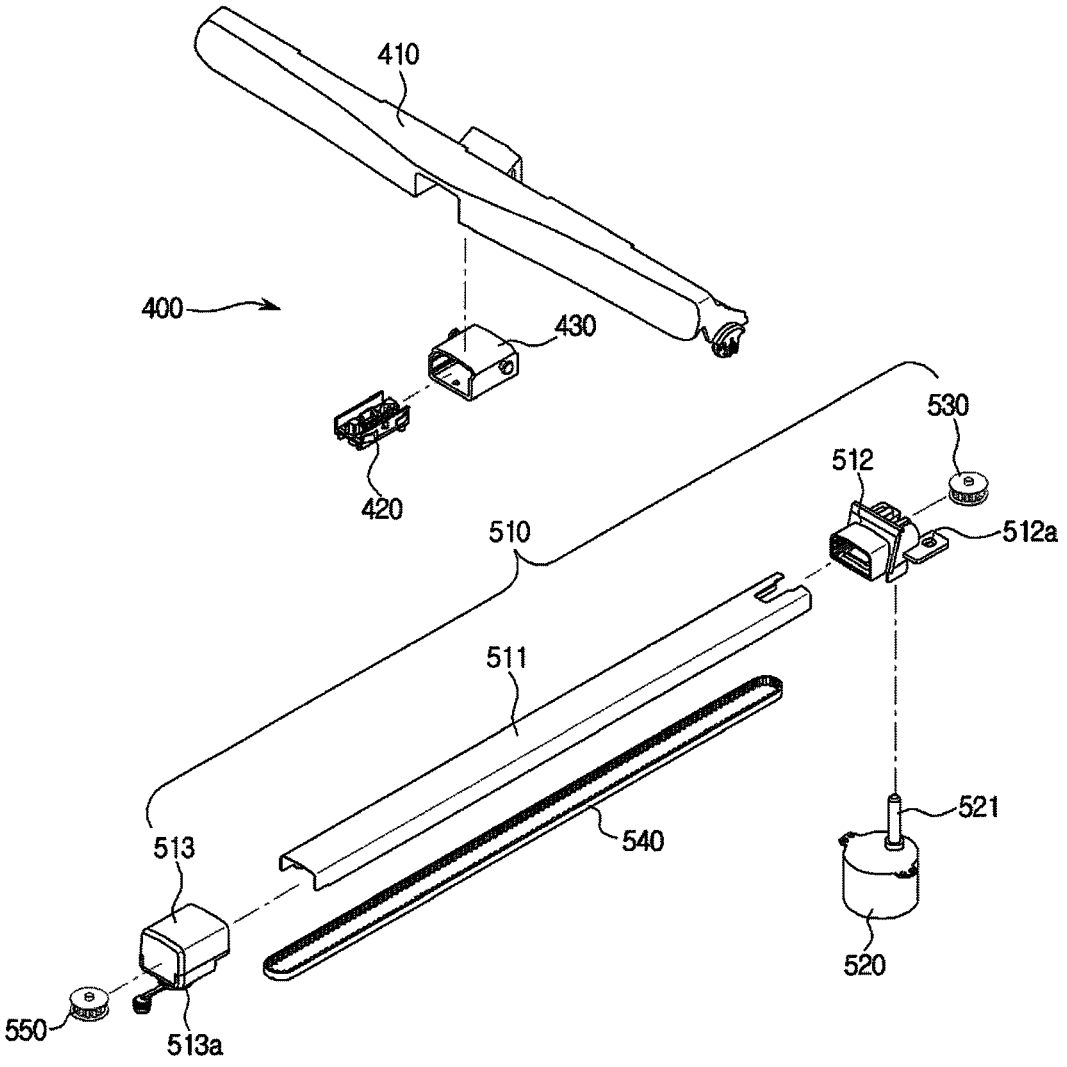
FIG. 7 illustrates configurations of the vane assembly and a vane drive assembly included in the dishwashing machine according to various embodiments of the present disclosure.
Figure 8:
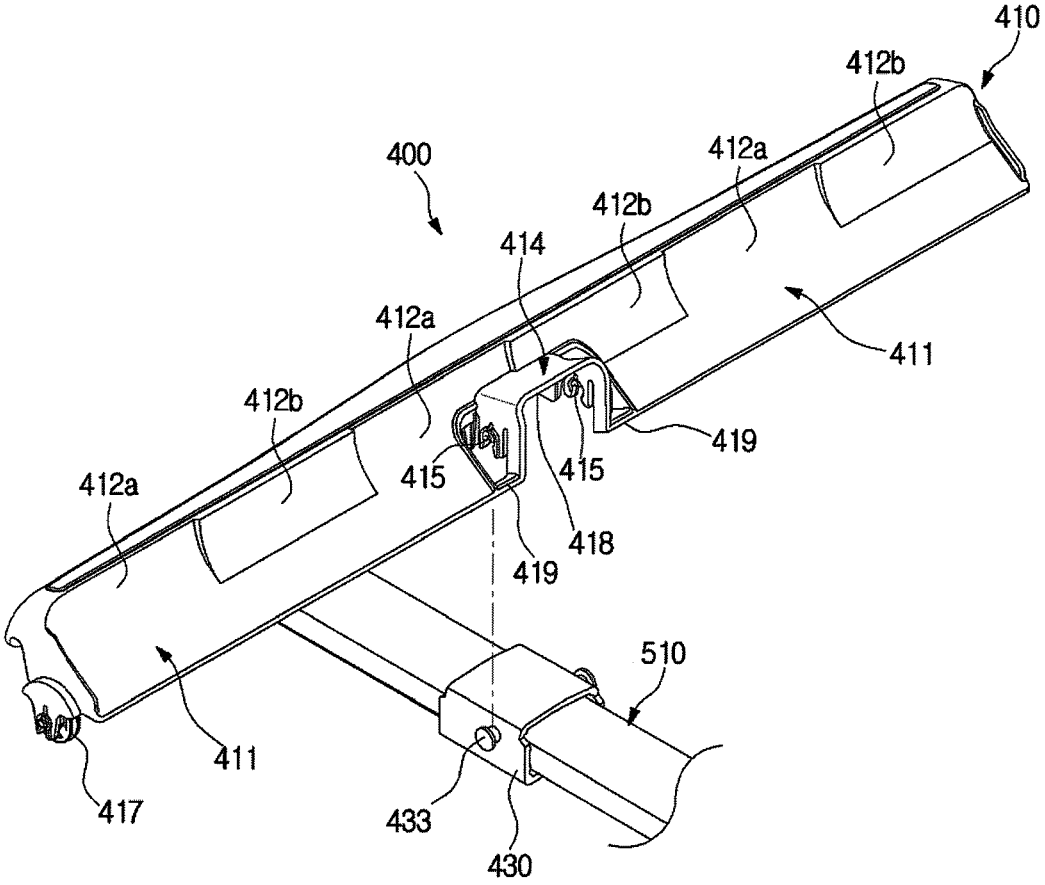
FIG. 8 illustrates a configuration of a vane assembly included in the dishwashing machine according to various embodiments of the present disclosure.
Figure 9:
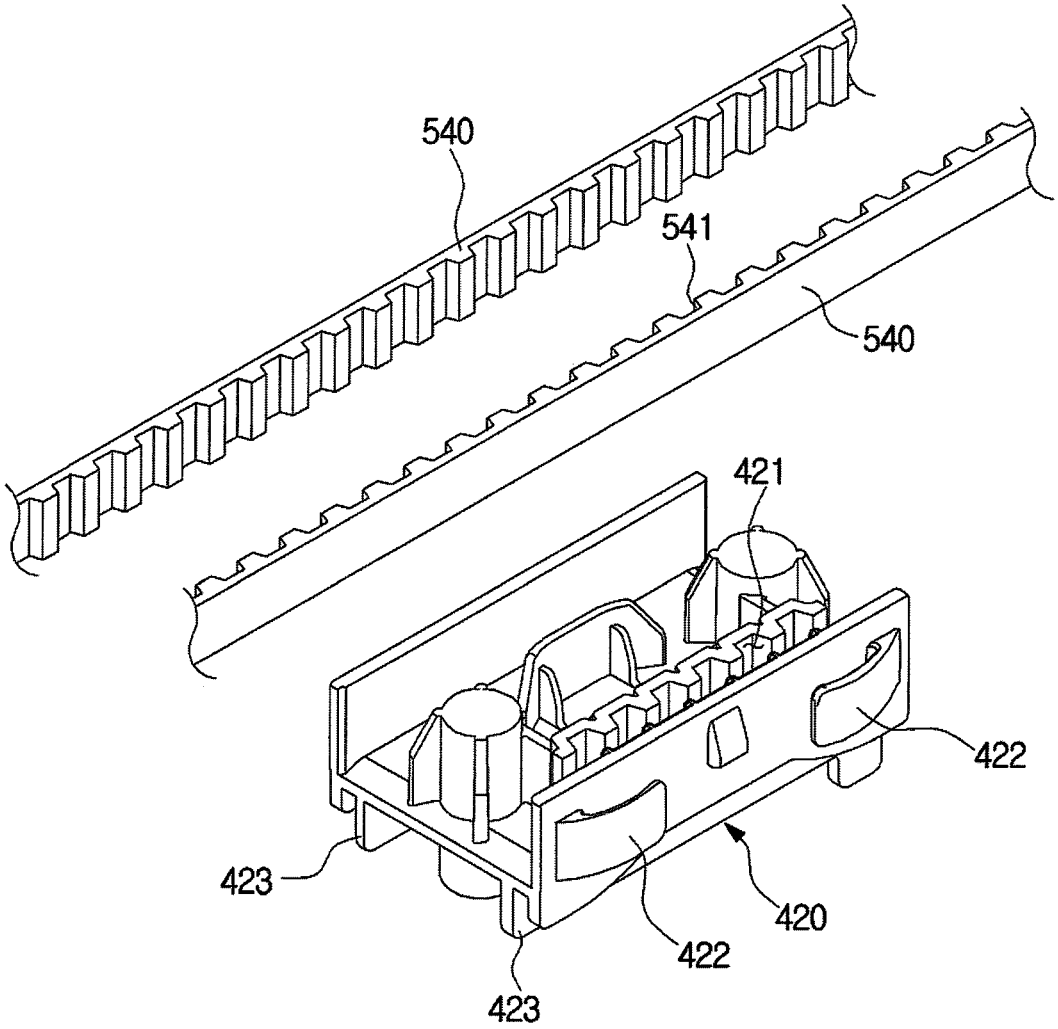
FIG. 9 illustrates configurations of a belt and a vane carrier included in the dishwashing machine according to various embodiments of the present disclosure.

FIG. 7 is a diagram illustrating configurations of the vane assembly and a vane drive assembly included in the dishwashing machine according to one embodiment, FIG. 8 is a diagram illustrating a configuration of a vane assembly included in the dishwashing machine according to another embodiment, and FIG. 9 is a diagram illustrating configurations of a belt and a vane carrier included in the dishwashing machine according to another embodiment.

As seen with reference to FIGS. 7 to 9, the dishwashing machine 1 includes the vane assembly 400 deflecting the washing water sprayed from the fixed nozzle 320, and the vane drive assembly 500 driving the vane assembly 400 to perform a rectilinear reciprocating motion.

The vane drive assembly 500 includes a vane guide 510 guiding movement of the vane assembly 400, a drive motor 520 generating a rotational force for moving the vane assembly 400, a drive pulley 530 that rotates through coupling with a drive shaft 521 of the drive motor 520, a drive belt 540 that rotates in engagement with the drive pulley 530 and is arranged in an inner space of the vane guide 510, and a driven pulley 550 engaged with the drive belt 540 to rotatably support the drive belt 540.

The vane guide 510 may be provided to extend lengthily in the front and rear directions on a center position centering on the left wall 33 and the right wall 34 of the tub 30.

The vane guide 510 includes a guide rail 511 having a tube shape in which an inner space and a lower opening portion are formed, a rear holder 512 rotatably supporting the drive pulley 530 and coupled to a rear end of the guide rail 511, and a front holder 513 rotatably supporting the driven pulley 550 and coupled to a front end of the guide rail 511.

The guide rail 511 is provided to extend lengthily in the front and rear directions on the center position centering on the left wall 33 and the right wall 34 of the tub 30, and the inner space and the lower opening portion of the guide rail 511 may extend lengthily from an end of the guide rail 511 to the other end thereof.

Second coupling holes 512*a* for fastening the vane guide 510 to a bottom plate cover 80 shown in FIG. 10, which will be described later, may be formed on the rear holder 512, and a coupling protrusion 513*a* for fastening the vane guide 510 to the bottom plate 35 shown in FIG. 3 may be formed on the front holder 513.

The vane drive motor 520 generates the rotational force for moving the vane assembly 400. The vane drive motor 520 may employ a direct current (DC) motor, an alternating current (AC) motor, or a stepping motor which are bidirectionally rotatable clockwise and counterclockwise, but is not limited thereto. Thus, the vane drive motor 520 may employ any kind of bidirectionally or unidirectionally rotatable motor.

Also, the vane drive motor 520 may include an encoder that selectively detects rotational displacement of the vane drive motor 520. When the vane drive motor 520 includes the encoder, the dishwashing machine 1 may calculate a movement distance of the vane assembly 400 based on revolution of the vane drive motor 520. For example, a movement distance of the vane assembly 400 is calculated by multiplying rotational displacement detected by the encoder by a radius of the drive pulley 530.

The drive belt 540 is arranged in the inner space formed in the guide rail 511 to form a closed curve by being wound around the drive pulley 530 and the driven pulley 550. Also, if the vane drive motor 520 is activated, the drive belt 540 may be rotationally moved in a rotational direction of the vane drive motor 520.

Such a drive belt 540 may be made of a resin material containing an aramid fiber in consideration of tensile strength and cost.

Teeth 541 may be formed on an inner lateral surface of the drive belt 540 to deliver a driving force to the vane assembly 400.

The vane assembly 400 includes a vane 410 deflecting the washing water sprayed from the fixed nozzle 320, a vane carrier 420 receiving the driving force from the drive belt 540, and a vane holder 430 coupled to the vane carrier and the vane 410.

The vane 410 may be provided to extend vertically with respect to the vane guide 510.

The vane 410 may include a deflector 411 deflecting the washing water sprayed from the fixed nozzle 320, a cap 414 provided on a center position of the deflector 411 in a length direction, a vane roller 417 smoothing movement of the vane 410, and a rotation preventer 419 interfering with a rotation guide 85 shown in FIG. 10 of a bottom plate cover 600, which will be described in later.

The deflector 411 includes deflection surfaces 412*a* and 412*b* that are inclined to deflect the washing water. The deflection surfaces 412*a* and 412*b* may include the first deflection surface 412*a* and the second deflection surface 412*b*, which have different inclines from each other and are alternately arranged in the length direction to deflect the washing water at different angles.

Figure 10:
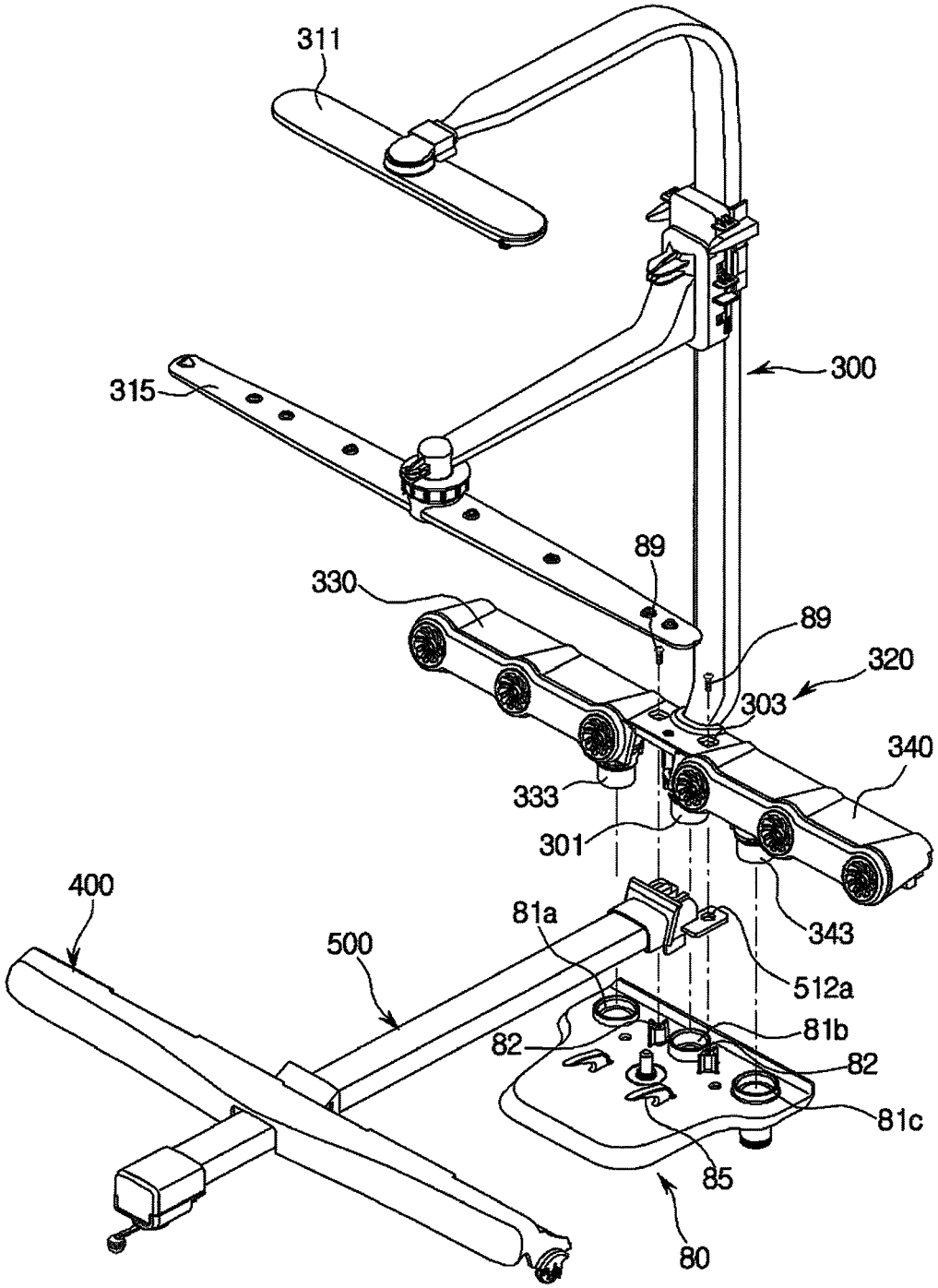
FIG. 10 illustrates a passage structure of a distribution valve assembly according to various embodiments of the present disclosure.

The cap 414 may include coupling depressions 415 for coupling to the vane holder 430, and a rotation stopper 418 limiting a rotation range of the vane 410 when the vane 410 is rotated by the rotation guide 85 shown in FIG. 10 of the bottom plate cover 80 shown in FIG. 10.

The coupling depressions 415 of the cap 414 may be coupled to coupling protrusions 433 of the vane holder 430. In particular, the coupling protrusions 433 may be inserted into the coupling depressions 415 of the deflector 411. The coupling protrusions 433 may rotatably support the vane 410.

Like the drive belt 540, the vane carrier 420 may be arranged within the inner space 2441 of the guide rail 511 and engaged with the teeth 541 of the drive belt 540, thereby moving together with the drive belt 540. For this purpose, the vane carrier 420 may have teeth 541 to be coupled to the teeth 541.

Also, the vane carrier 420 may include legs 422 and 423 supported by the guide rail 511. The legs 422 and 423 may include the lateral legs 422 that protrude laterally to be supported by a lateral wall of the guide rail 511, and the lower legs 423 that protrude downward to be supported by a lower wall of the guide rail 511.

The vane holder 430 is coupled to and moves together with the vane carrier 420 to deliver the driving force of the vane carrier 420 to the vane 410. The vane holder 430 is provided to wrap around an outer lateral surface of the guide rail 511.

The vane holder 430 is coupled to the vane carrier 420 through the lower opening portion of the guide rail 511, and the coupling protrusions 433 to which the vane 410 is separably coupled may be formed on the vane holder 430.

Referring back to FIG. 5, the dishwashing machine 1 may further include a distribution valve assembly 200. The distribution valve assembly 200 may distribute the washing water supplied to the nozzle assembly 300 for divided washing.

The distribution valve assembly 200 may distribute the washing water to enable the upper nozzle 311, the center nozzle 315, and the fixed nozzle 320 to independently spray the washing water. Therefore, the dishwashing machine 1 may wash the upper and lower ends of the tub 30 separately and independently.

Also, the distribution valve assembly 200 may distribute the washing water to enable the left nozzle 330 and the right nozzle 340 of the fixed nozzle 320 to independently spray the washing water. Therefore, the dishwashing machine 1 may wash the left and right of the tub 30 separately and independently. Hereinafter, for convenience of explanation, it will be described that the fixed nozzle 320 is divided into the right nozzle 340 and the left nozzle 330, but it is not limited thereto, and it should be understood that the fixed nozzle 320 may be subdivided into multiple nozzles as necessary.

Figure 11:
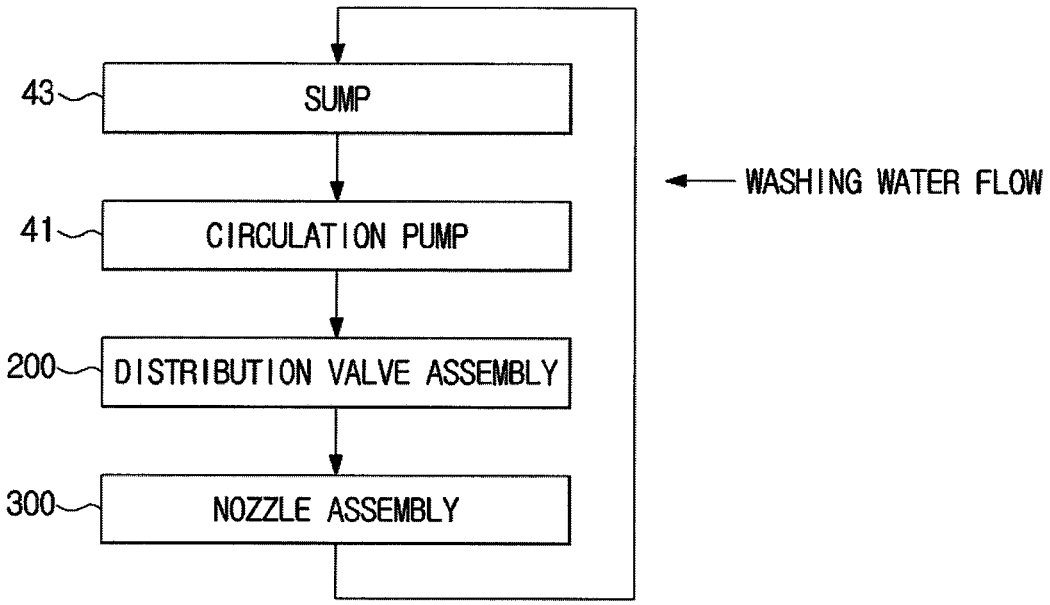
FIG. 11 illustrates washing water circulation in the dishwashing machine according to various embodiments of the present disclosure.

FIG. 10 is a diagram for explaining a passage structure of the distribution valve assembly, and FIG. 11 is a diagram illustrating washing water circulation in the dishwashing machine according to one embodiment.

Hereinafter, with reference to FIGS. 5, 10, and 11, washing water circulation in the dishwashing machine 1 according to one embodiment will be described in detail. The dishwashing machine 1 may include the sump 43 accommodating the washing water, a circulation pump 41 pumping and supplying the washing water of the sump 43 to the nozzle assembly 300, and a drain pump 51 discharging the washing water of the sump 43 together with waste to the outside of the main body 10.

After hitting the tableware, the washing water sprayed through the nozzle assembly 300 moves to the sump 43 provided at the lower of the tub 30. A circulation tube 42, which is a passage through which the washing water moves to the circulation pump 41, and a drain 52 for discharging the washing water and the waste may be provided on the sump 43.

The circulation pump 41 is connected to the distribution valve assembly 200, which distributes the washing water, to pump the washing water thereto. That is, the circulation pump 41 supplies the washing water to the nozzle assembly 300 at a high pressure in order to spray the washing water at a high pressure.

The distribution valve assembly 200 is connected to the nozzle assembly 300 through a hose. The hose may be connected to each nozzle of the nozzle assembly 300. For example, a first hose 271*a* may be connected to a washing water inlet 333 of the left nozzle 330, a third hose 271*c* may be connected to a washing water inlet 343 of the right nozzle 340, and a second hose 271*b* may be connected to a washing water inlet 301 for supplying the washing water to the upper nozzle 331 and the center nozzle 315. The distribution valve assembly 200 may distribute the washing water supplied through the circulation pump 41 to at least one of the hoses.

Meanwhile, unlike FIG. 5, the upper nozzle 311 and the center nozzle 315 may each have a separated passage. When the upper nozzle 311 and the center nozzle 315 each have a separated passage, the distribution valve assembly 200 may independently distribute the washing water to the upper nozzle 311 and the center nozzle 315.

The washing water, which is supplied to the nozzle assembly 300 through the distribution valve assembly 200, is sprayed by the spray nozzle 311, 315, and 320 to hit the tableware, and then moves back to the sump 43.

Figure 12:
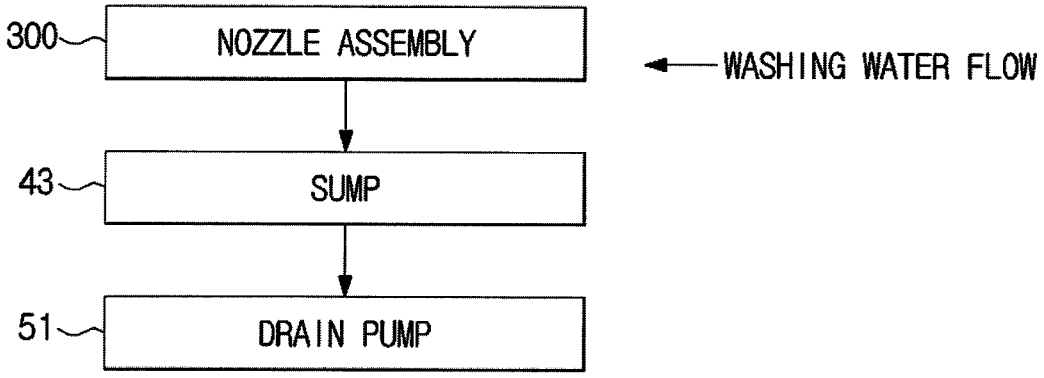
FIG. 12 illustrates washing water drainage of the dishwashing machine according to various embodiments of the present disclosure.

When the washing is completed, the washing water is discharged to the outside of the dishwashing machine. FIG. 12 is a diagram illustrating washing water drainage of the dishwashing machine according to one embodiment.

With reference to FIGS. 3 and 12, the washing water sprayed through the nozzle assembly 300 hits the tableware and then moves to the sump 43.

The drain pump 51 discharges the washing water accommodated on the sump 43 to the outside of the dishwashing machine 1. In particular, after the washing process or rinsing process is completed, the drain pump 51 may pump the washing water accommodated on the sump 43 to the outside of the dishwashing machine 1.

Meanwhile, the valve assembly 200, the nozzle assembly 300, and the vane drive assembly 500, which have been described in detail, may be connected to each other through the bottom plate cover 80 shown in FIG. 10.

The bottom plate cover 80 is provided on one rear side of the bottom plate 35 to firmly fasten multiple assemblies thereto and to seal the washing water and prevent leakage.

The bottom plate cover 80 may include multiple connectors 81*a*, 81*b*, and 81*c* for connecting the hoses 271*a*, 271*b*, and 271*c* extending from the distribution valve assembly 200 to the washing water inlets 333, 301, and 343 of the nozzle assembly 300.

Lower ends of the multiple connectors 81*a*, 81*b*, and 81*c* are connected to ends of the hoses 271*a*, 271*b*, and 271*c* shown in FIG. 10, and upper ends of the multiple connectors 81*a*, 81*b*, and 81*c* are connected to the washing water inlets 331, 301, and 343 of the nozzle assembly 300. At this time, the multiple connectors 81*a*, 81*b*, and 81*c* may undergo a sealing treatment.

Also, the bottom plate cover 80 includes third coupling holes 82 for fastening the vane assembly 400 to the nozzle assembly 300. The third coupling holes 82 are provided on positions corresponding to the second coupling holes 512*a* provided on the vane drive assembly 500 and first coupling holes 303 provided on the nozzle assembly 300. Therefore, the nozzle assembly 300 and the vane drive assembly 500 may be firmly fastened through coupling members 89.

The dishwashing machine 1 according to one embodiment may perform the divided washing. As described in detail, the dishwashing machine 1 may control a distribution of the washing water using the distribution valve assembly 200 to wash one of the upper and lower accommodation racks 22*a* and 22*b* through such washing water distribution control.

Specifically, the lower accommodation rack 22*b* may be subdivided into multiple zones to perform divided washing. The lower accommodation rack 22*b* is washed by the washing water sprayed from the center nozzle 315 and the fixed nozzle 320. As shown in FIG. 6, the traveling direction of the washing water sprayed from the fixed nozzle 320 is redirected to the lower accommodation rack 22*b* by the vane assembly 400 and then the tableware is washed by the redirected washing water.

Therefore, the dishwashing machine 1 may control a forward and backward movement range of the vane assembly 400 to perform the divided washing in the front and rear directions. Hereinafter, with reference to FIGS. 13 to 15, the divided washing of the lower accommodation rack 22*b* of the dishwashing machine 1 will be described in detail.

Figure 13:
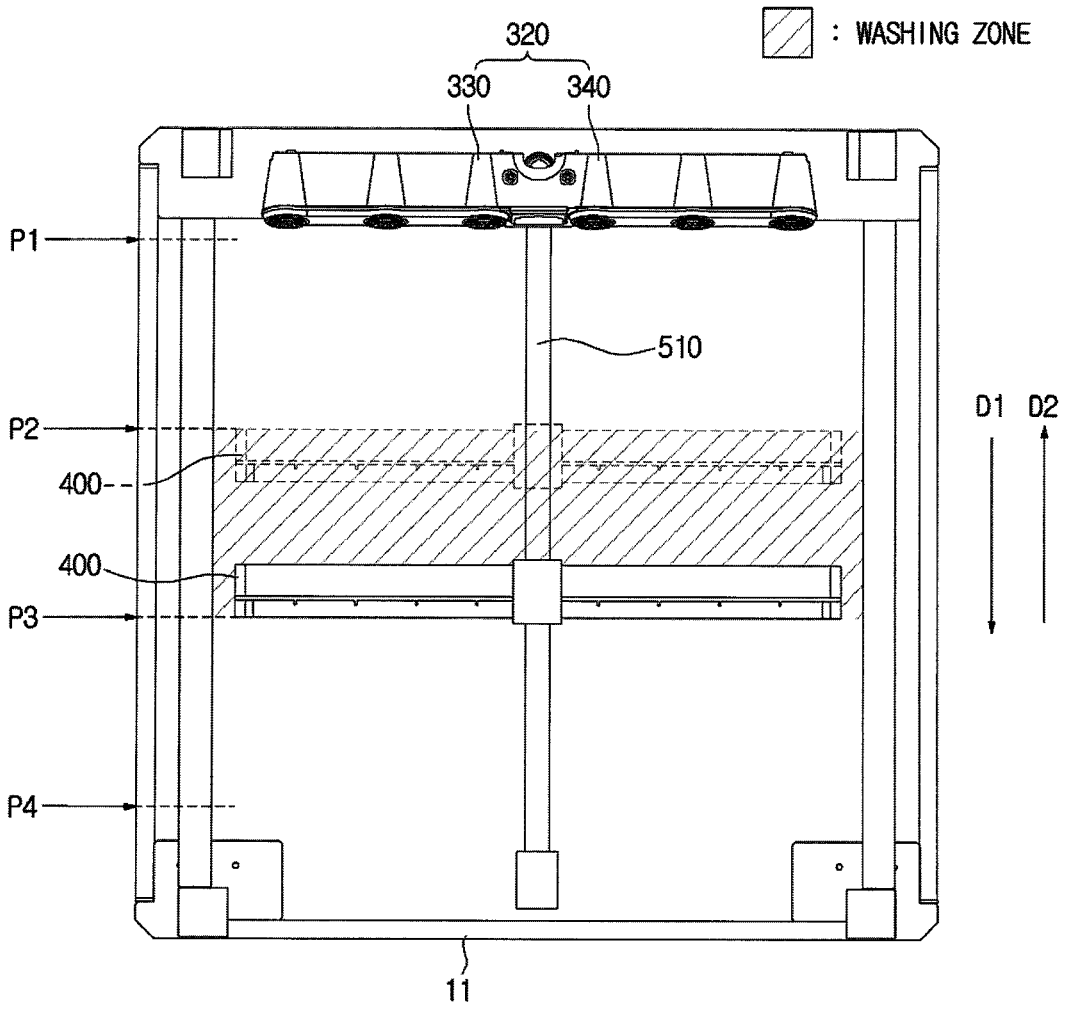
FIG. 13 illustrates divided washing in front and rear directions of the dishwashing machine according to various embodiments of the present disclosure.
Figure 14:
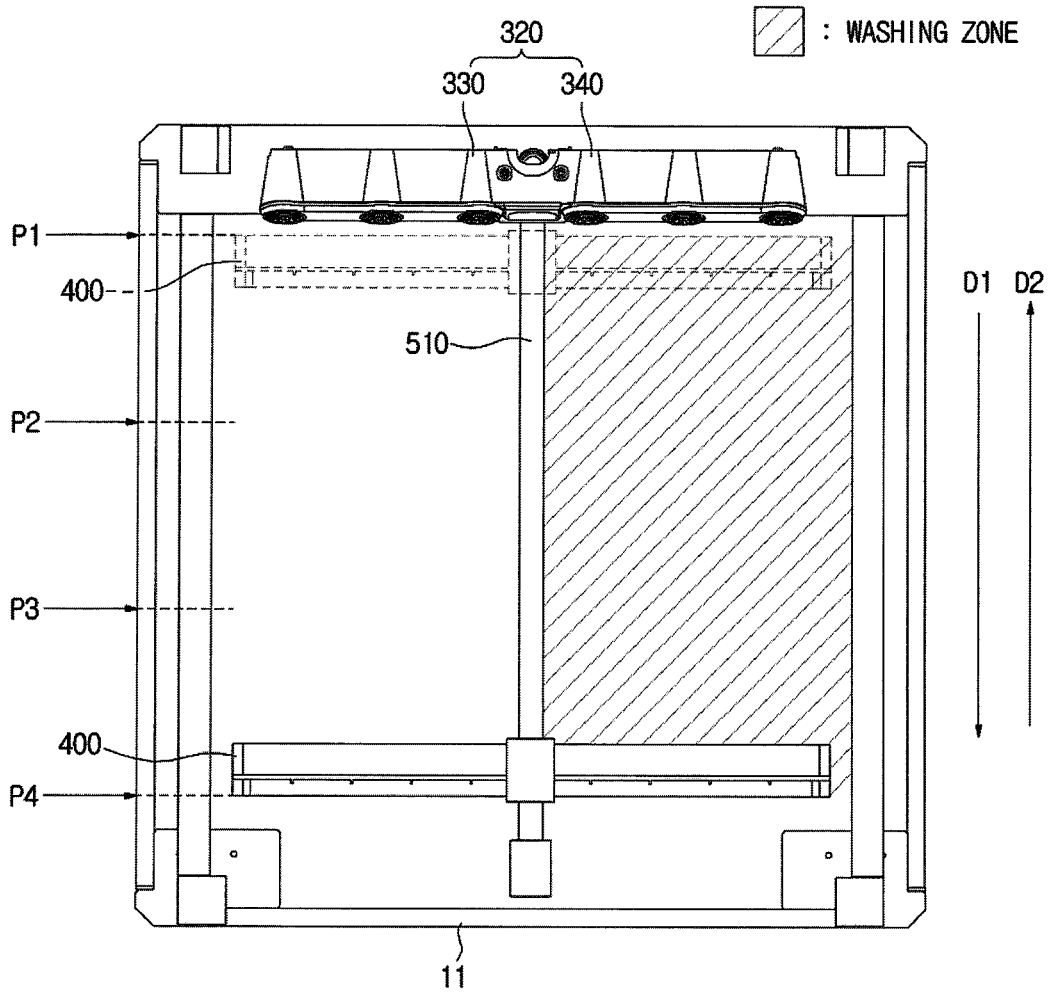
FIG. 14 illustrates divided washing in left and right directions of the dishwashing machine according to various embodiments of the present disclosure.
Figure 15:
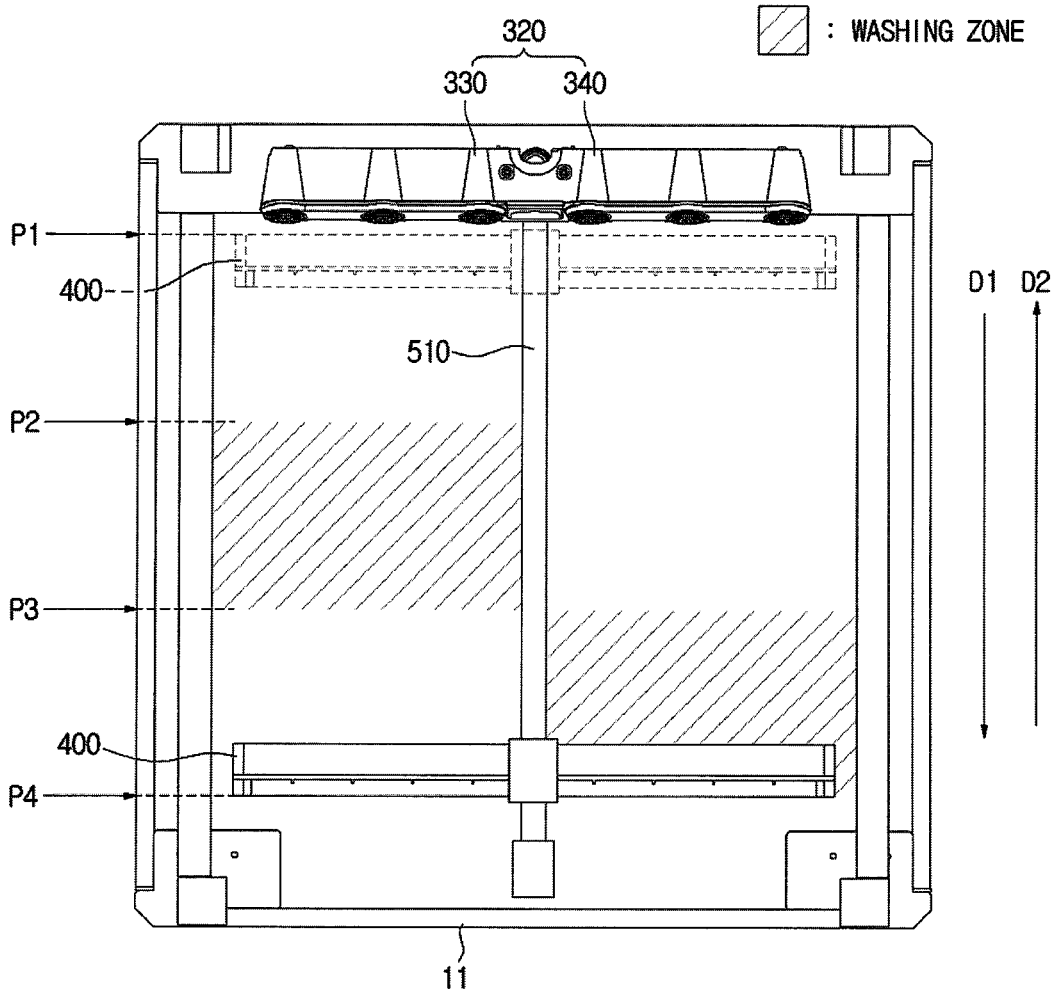
FIG. 15 illustrates composite divided washing of the dishwashing machine according to various embodiments of the present disclosure.

FIG. 13 is a diagram for explaining the divided washing in the front and rear directions of the dishwashing machine according to one embodiment, FIG. 14 is a diagram for explaining the divided washing in left and right directions of the dishwashing machine according to one embodiment, and FIG. 15 is a diagram for explaining composite divided washing of the dishwashing machine according to one embodiment.

With reference to FIGS. 5 and 13, the lower accommodation rack 22*b* may be washed in the divided washing according to movement control of the vane assembly 400.

When the accommodation rack 22*b* is totally washed, the vane assembly 400 may evenly deflect the washing water to all zones of the lower accommodation rack 22*b* while travelling back and forth between first and fourth positions P1 and P4.

When only a central zone of the lower accommodation rack 22*b* is selected as a washing zone, the vane assembly 400 may travel back and forth between second and third positions P2 and P3, which correspond to the central zone, to intensively deflect the washing water to the central zone.

That is, the dishwashing machine 1 may control a rectilinear movement range of the vane assembly 400 to perform the divided washing in the front and rear directions.

Also, as described in detail, the fixed nozzle 320 includes the left nozzle 330 and the right nozzle 340. Since the spraying of the washing water of the left nozzle 330 and the right nozzle 340 may be controlled according to the washing water distribution of the distribution valve assembly 200, the washing water may be sprayed from one of the left and right nozzles 330 and 340. Therefore, the washing water distribution in the dishwashing machine 1 may be controlled by the distribution valve assembly 200

When the distribution valve assembly 200 distributes the washing water to both of the left nozzle 330 and the right nozzle 340, the washing water is sprayed from the left and right nozzles 330 and 340 to wash both of left and right zones as shown in FIG. 13.

Also, when the distribution valve assembly 200 distributes the washing water only to the left nozzle 330, the washing water is sprayed from the left nozzle 330 to wash the left zone of the lower accommodation rack 22*b* in the divided washing, and when the washing water is distributed only to the right nozzle 330, the washing water is sprayed from the right nozzle 330 to wash the right zone of the lower accommodation rack 22*b* in the divided washing.

Also, the dishwashing machine 1 may perform the composite divided washing by controlling movement of the vane assembly 400 and washing water distribution.

For example, when a left central zone and a right front zone are selected as the divided washing zones, divided washing is performed as shown in FIG. 15.

With reference to FIG. 15, the vane assembly 400 may travel back and forth between positions corresponding to the divided washing zones. In particular, the vane assembly 400 may travel back and forth between the second and third positions P2 and P3 corresponding to the central zone and between the third and fourth positions P3 and P4.

Also, the dishwashing machine 1 may control the washing water distribution of the distribution valve assembly 200 according to a position of the vane assembly 400.

In particular, the left nozzle 330 may spray the washing water only when the vane assembly 400 is located at positions corresponding to the left central zone. That is, the left nozzle 330 may spray the washing water only when the vane assembly 400 travels between the second and third positions P2 and P3 corresponding to the central zone.

The right nozzle 340 may spray the washing water only when the vane assembly 400 is located at positions corresponding to the right front zone. That is, the right nozzle 340 may spray the washing water only when the vane assembly 400 travels between the third and fourth positions P3 and P4 corresponding to the front zone.

Figure 16:
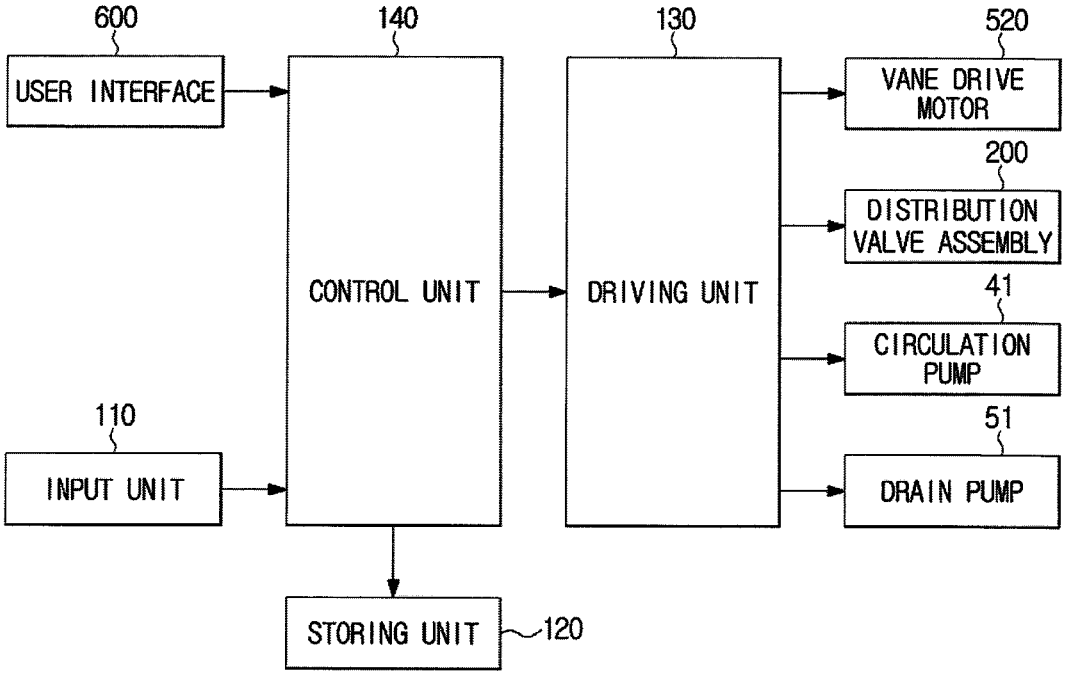
FIG. 16 illustrates a control flow of the dishwashing machine according to various embodiments of the present disclosure.

FIG. 16 is a control block diagram illustrating a control flow of the dishwashing machine according to one embodiment.

With reference to FIG. 16, the dishwashing machine 1 according to one embodiment may include the user interface 600, a storing unit 120, a driving unit 130, and a control unit 140.

The storing unit 120 stores programs and data for controlling operation of the dishwashing machine 1. For example, the storing unit 120 may store multiple programs for performing a washing method that is selected through a washing course selection button to be described later.

Also, the storing unit 120 may include a nonvolatile memory (not shown), such as a magnetic disk, a solid state disk, and the like, for permanently storing data, as well as a volatile memory (not shown), such as a dynamic random access memory (DRAM), a static random access memory (SRAM), and the like, for temporarily storing temporal data that is generated while controlling the operation of the dishwashing machine 1.

The driving unit 130 drives components included in the dishwashing machine 1 according to a control signal of the control unit 140 to be described later. In particular, the driving unit 130 includes a driving circuit (not shown) generating a drive current for driving the circulation pump 41, the drain pump 51, the distribution valve assembly 200, and a vane drive motor 520. For example, the driving unit 130 may include an H-bridge circuit (not shown) for driving the vane drive assembly 500 that moves the vane assembly 400 forward and backward.

The user interface 600 may receive a control instruction for the dishwashing machine 1, output an electrical signal corresponding to the received control instruction, and display a variety of information with respect to the dishwashing machine 1. In particular, the user interface 600 may receive a user input for the divided washing. The user interface 600 may receive a washing zone in which divided washing is to be performed among all zones in the tub 30, or a washing method for each of the washing zones.

The control unit 140 controls an operation of each component included in the dishwashing machine 1 according to the control instruction input through the user interface 600. In particular, the control unit 140 provides the driving unit 130 with a control signal for controlling the pump 41, the drain pump 51, the distribution valve assembly 200, and the vane drive motor 520 based on an operation instruction of the user input through an input unit 110.

That is, the control unit 140 may control movement of the vane assembly 400 and distribution of the washing water to enable the divided washing to be performed according to the washing zone selected through the user interface 600.

Also, the control unit 140 may control a washing time, a spray amount of the washing water, or a forward and backward movement speed of the vane assembly 400 according to the washing method selected through the user interface.

Hereinafter, the user interface 600 for inputting a divided washing instruction and a performance method of the divided washing will be described in detail.

Figure 17:
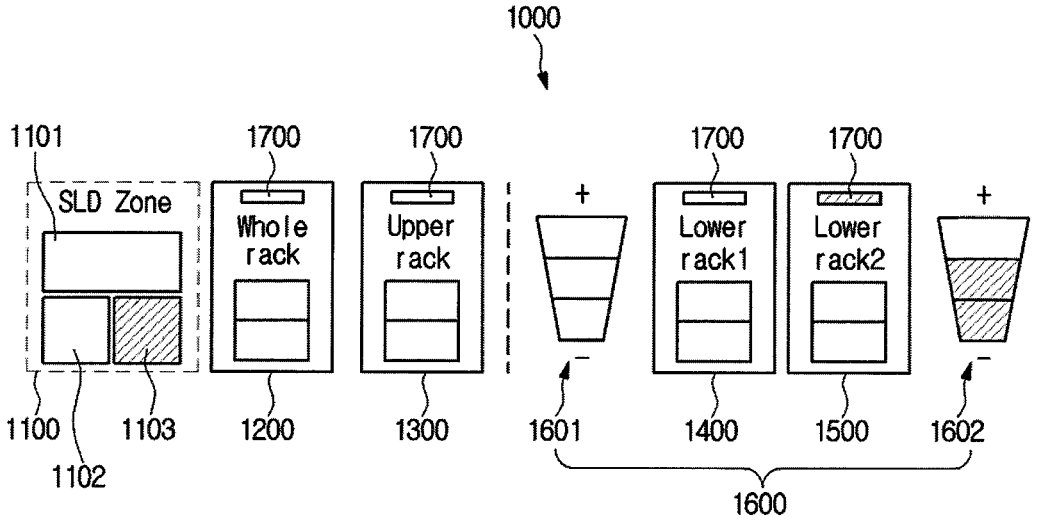
FIG. 17 illustrates one embodiment of a user interface for inputting a divided washing instruction according to various embodiments of the present disclosure.

FIG. 17 is a diagram illustrating one embodiment of the user interface for inputting the divided washing instruction.

With reference to FIG. 17, the user interface 600 may include a display 1100 for displaying a washing zone in which the divided washing is selected, and a washing zone selection unit for selecting a washing zone.

The display 1100 may be divided into regions corresponding to washing zones to which the divided washing is applicable, and a washing zone in which the divided washing is selected may be displayed. In particular, a first region 1101 may display the upper accommodation rack 22*a* provided at the upper end of the tub 30, a second region 1102 may display the left zone of the lower accommodation rack 22*b* provided at the lower end of the tub 30, and a third region 1103 may display the right zone of the lower accommodation rack 22*b*.

The washing zone selection unit may include a select all button 1200 for receiving selection of both of the accommodation racks 22*a* and 22*b* as a washing zone, an upper end selection button 1300 for performing the divided washing on the upper accommodation rack 22*a* provided at the upper end of the tub 30, a left selection button 1400 for performing the divided washing on the left zone of the lower accommodation rack 22*b* provided at the lower end of the tub 30, and a right selection button 1500 for performing the divided washing on the right zone of the lower accommodation rack 22*b*.

Also, each button 1200, 1300, 1400, and 1500 of the washing zone selection unit may include a first indicator 1700. A light emitting element such as a light emitting diode (LED) lamp that lights up according to a button selection of the user to display a selected washing zone may be employed as the first indicator.

For example, when the user selects the right selection button 1500, the first indicator 1700 provided on the right selection button 1500 may light up or flicker together with the third region 1103 corresponding to the right zone of the lower accommodation rack 22*b*.

The user interface 600 may further include a second indicator 1600 for displaying a washing method. The second indicator 1600 may display a washing method, for example, a washing power, for a divided washing zone.

The second indicator 160 may include a left indicator 1601 for indicating a washing power in the left zone of the lower accommodation rack 22*b*, and a right indicator 1602 for indicating a washing power in the right zone thereof.

At this point, the washing power may be set according to a number of inputs by the user. For example, when the washing power can be adjusted in three levels, the first washing power may be set when the user presses the right selection button 1500 once, the second washing power may be set when the user presses the right selection button 1500 a second time, and the third washing power may be set when the user presses the right selection button 1500 a third time. In addition, when the user presses the right selection button 1500 a fourth time, the divided washing selection for the right zone of the lower accommodation rack 22*b* may be canceled.

Figure 18:
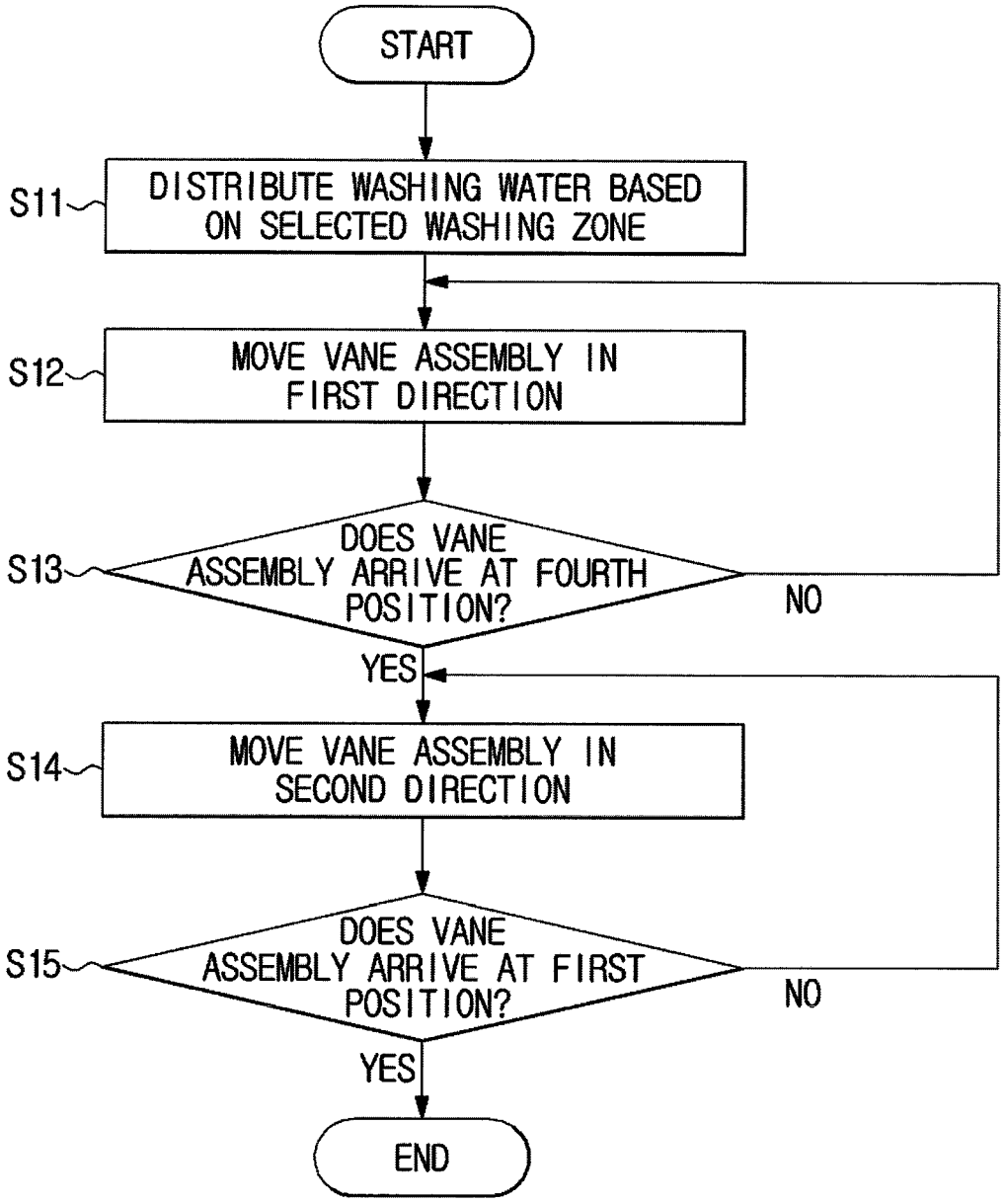
FIG. 18 illustrates divided washing according to the divided washing instruction according to various embodiments of the present disclosure.

FIG. 18 is a flow chart for explaining one embodiment of the divided washing according to the divided washing instruction.

With reference to FIGS. 14 and 18, once the divided washing instruction has been input, the dishwashing machine 1 performs the divided washing.

The dishwashing machine 1 distributes the washing water based on the selected washing zone (S11). For example, when both of the accommodation racks 22*a* and 22*b* are selected, the dishwashing machine 1 may distribute the washing water to enable all nozzles of the nozzle assembly 300 to spray the washing water, and when the upper accommodation rack 22*a* is selected as the divided washing zone, the dishwashing machine 1 may distribute the washing water only to the upper nozzle 311 and the center nozzle 315.

Also, when the left zone of the lower accommodation rack 22*b* is selected, the dishwashing machine 1 may distribute the washing water to the left nozzle 330, and when the right zone of the lower accommodation rack 22*b* is selected, the dishwashing machine 1 may distribute the washing water to the right nozzle 340.

Further, when the left zones of the upper and lower accommodation racks 22*a* and 22*b* are selected as the washing zones, the dishwashing machine 1 may distribute the washing water to the upper nozzle 311, the center nozzle 315, and the left nozzle 330.

Furthermore, when the right zones of the upper and lower accommodation racks 22*a* and 22*b* are selected as the washing zones, the washing water may be distributed to the upper nozzle 311, the center nozzle 315, and the right nozzle 340.

In addition, the dishwashing machine 1 may control distribution of the washing water according to a washing power. Since the washing power may be adjusted according to a spray pressure of the washing water, the dishwashing machine 1 may distribute the washing water in proportion to the washing power. For example, when the left zone of the lower accommodation rack 22*b* is set to the first washing power and the right zone thereof is set to the third washing power, more of the washing water may be distributed to the right nozzle 340 than the left nozzle 330 to increase the washing power in the right zone.

Then, the dishwashing machine 1 makes the vane assembly 400 move in a first movement direction D1 (S12). The first movement direction D1 represents a direction in which the vane guide 510 moves toward the fourth position P4 from a certain position, and thus the vane drive motor 520 shown in FIG. 7 may be driven in a first rotation direction to move the vane assembly 400 in the first movement direction D1.

The dishwashing machine 1 determines whether or not the vane assembly 400 arrives at the fourth position P4 (S13). The fourth position P4 represents one end of the vane guide 510 to which the vane assembly 400 moves. For example, the fourth position P4 may be one of both ends of the vane guide 510 opposite to the fixed nozzle 300.

The dishwashing machine 1 may determine a position of the vane assembly 400 through a variety of methods.

For example, the dishwashing machine 1 may determine a position of the vane assembly 400 based on a movement speed and a movement time of the vane assembly 400. A position of the vane assembly 400 may be calculated by adding a movement distance of the vane assembly 400 to a position of the vane assembly 400 prior to moving.

The movement distance of the vane assembly 400 may be calculated based on the movement speed and the movement time thereof. At this point, the movement speed of the vane assembly 400 is determined according to a rotational speed of the vane drive motor 520 shown in FIG. 7, and the movement time thereof is determined according to an operation time of the vane drive motor 520.

The dishwashing machine 1 may calculate the movement distance of the vane assembly 400 based on the operation time and the rotational speed of the vane drive motor 520 shown in FIG. 7, and determine a real-time position of the vane assembly 400 by adding the calculated movement distance to a position of the vane assembly 400 prior to moving. That is, the dishwashing machine 1 may determine whether or not the vane assembly 400 arrives at the fourth position based on the operation time and the rotational speed of the vane drive motor 520 shown in FIG. 7.

As another embodiment, the dishwashing machine 1 may determine a position of the vane assembly 400 based on rotational displacement of the vane drive motor 520 shown in FIG. 7.

When the vane drive motor 520 shown in FIG. 7 includes an encoder detecting rotational displacement, the dishwashing machine 1 may calculate a movement distance of the vane assembly 400 according to the driving of the vane drive motor 520 and add the calculated movement distance to a position of the vane assembly 400 prior to moving, thereby calculating a position of the vane assembly 400.

In particular, the movement distance of the vane assembly 400 may be calculated by multiplying rotational displacement thereof detected by the encoder by a radius of the drive pulley 530.

As still another embodiment, the dishwashing machine 1 may determine a position of the vane assembly 400 by detecting a position thereof using a position sensor. The position sensor may be any kind of sensor that can be used to calculate a position of the vane assembly 400 being moved. For example, a Hall sensor detecting magnetic field variation due to movement of the vane assembly 400 to calculate a position thereof based on the detected magnetic field variation, a distance sensor calculating a relative distance with respect to the vane assembly 400 using infrared rays or ultrasonic waves, a touch sensor sensing a touch of the vane assembly 400 to detect a position thereof, and the like may be employed as the position sensor.

If the vane assembly 400 arrives at the fourth position P4 (YES in S13), the dishwashing machine 1 moves the vane assembly 400 in a second movement direction D2 (S14). Particularly, in order to move the vane assembly 200 in the second movement direction D1, the dishwashing machine 1 may drive the vane drive motor 520 in a second rotational direction.

Thereafter, the dishwashing machine 1 determines whether or not the vane assembly 400 arrives at the position P1 (S15). Determination of arrival at the first position P1 may be the same as determination of arrival at the fourth position P4 that has been described in detail.

The dishwashing machine 1 may repeat S12 to S15, which have been described in detail, to wash the tableware.

Figure 19:
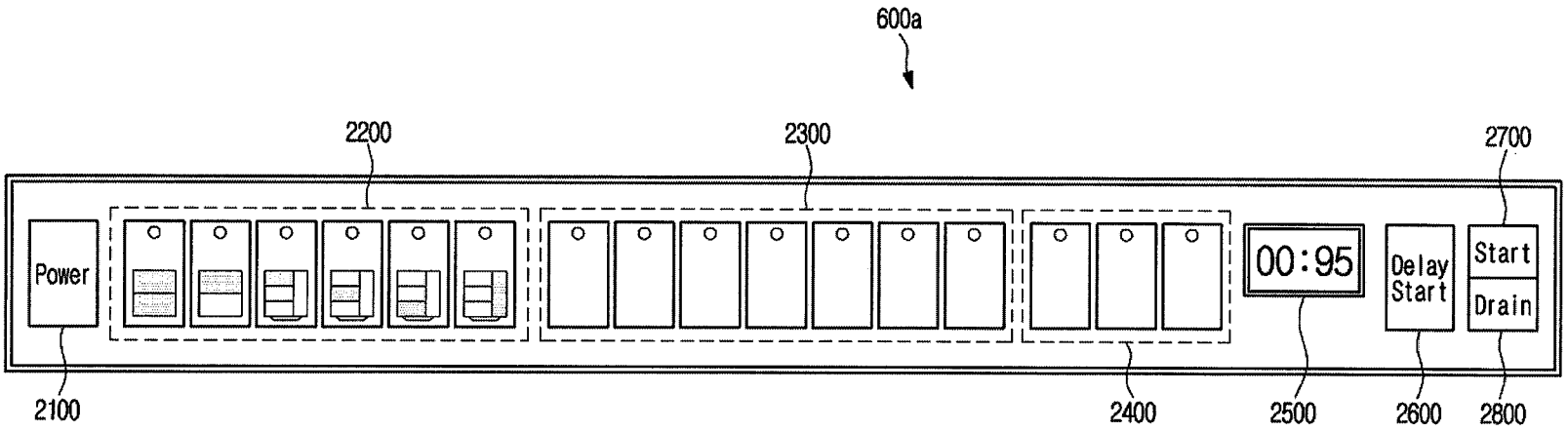
FIG. 19 illustrates a user interface for inputting the divided washing instruction according to various embodiments of the present disclosure.
Figure 20:
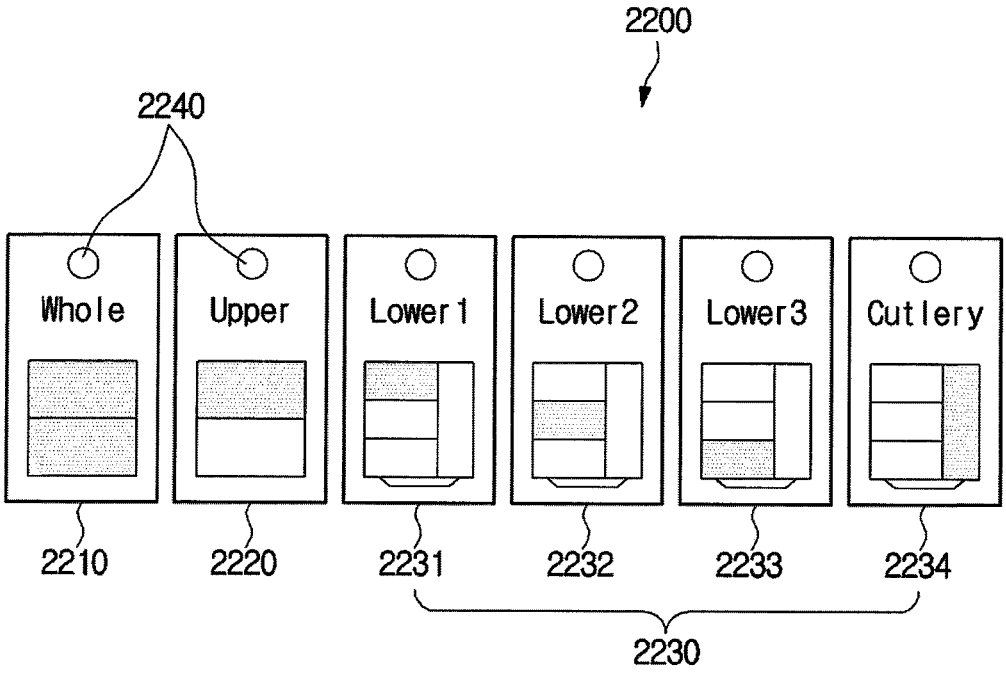
FIG. 20 illustrates a washing zone selection unit of FIG. 19 according to various embodiments of the present disclosure.
Figure 21:
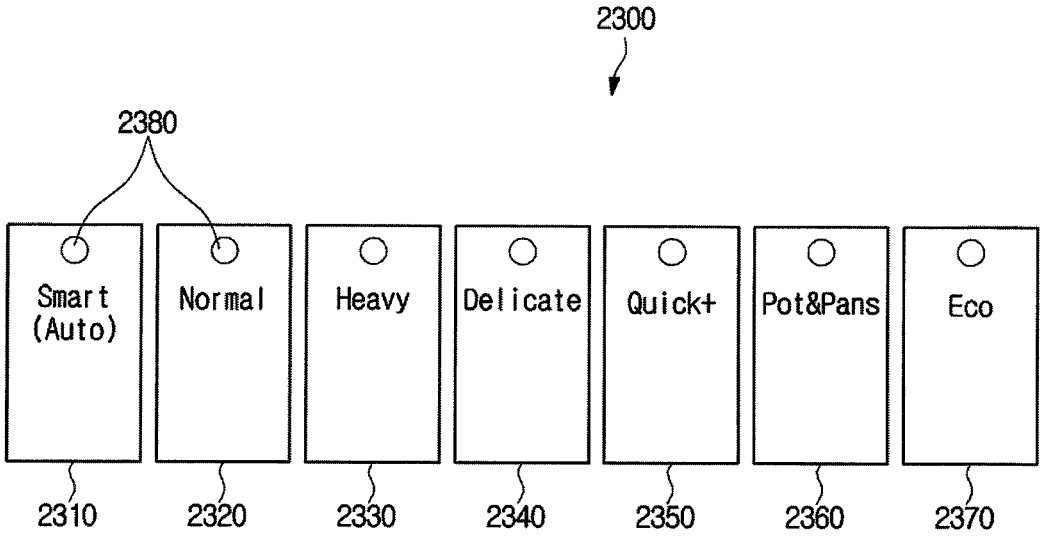
FIG. 21 illustrates a washing course selection unit of FIG. 19 according to various embodiments of the present disclosure.

FIG. 19 is a diagram illustrating another embodiment of a user interface for inputting the divided washing instruction, FIG. 20 is a diagram illustrating one embodiment of the washing zone selection unit of FIG. 19, and FIG. 21 is a diagram illustrating one embodiment of a washing course selection unit of FIG. 19.

With reference to FIG. 19, a user interface 600*a* may include a power button 2100 for operating the dishwashing machine 1, a washing zone selection unit 2200 for selecting a washing zone in which divided washing is to be performed, a washing course selection unit 2300 for selecting a washing method in a washing zone, an option selection unit 2400 for setting options, a display 2500 displaying information related to the dishwashing machine 1, a reservation button 2600 for reserving washing, a washing start button 2700, and a drain button 2800.

The display 2500 may be implemented as display means as described above to display information including an estimated washing time, a remaining washing time, a selected washing zone, a selected washing method, various errors, and the like.

The washing zone selection unit 2200 may include multiple zone selection buttons for selecting a washing zone in which the divided washing is to be performed. The zone selection button may be provided for each of washing zones to which the divided washing is applicable.

For example, as shown in FIG. 20, the washing zone selection unit 2200 includes a select all button 2210 for selecting both of the upper and lower accommodation racks 22*a* and 22*b* as washing zones, an upper end selection button 2220 for selecting the upper accommodation rack 22*a* provided on the upper end of the tub 30, and a lower end selection button 2230 for performing the divided washing on the lower accommodation rack 22*b* provided on the lower end of the tub 30.

As described above, the left and right zones of the lower accommodation rack 22*b* may be washed in the divided washing according to distribution of the washing water, and the front and rear zones thereof may be washed in the divided washing according to movement of the vane assembly 400.

Therefore, the lower selection button 2230 may include a rear selection button 2231 for selecting a left rear zone of the lower accommodation rack 22*b* as a divided washing zone, a center selection button 2232 for washing the tableware stored in a left center zone of the lower accommodation rack 22*b*, a front selection button 2233 for washing the tableware stored in a left front zone of the lower accommodation rack 22*b* in the divided washing, and a right selection button 2234 for washing the tableware stored in the right zone of the lower accommodation rack 22*b*.

In addition, the washing zone selection unit 2200 may further include a first indicator 2240 for displaying a selected washing zone. As shown in FIG. 20, the first indicator 2240 may be formed as one unit with each of the selection buttons to display a washing zone selected by the user. A light emitting element such as an LED lamp that lights up or flickers when the selection button is pressed to display a selected washing zone may be employed as the first indicator 2240.

The washing course selection unit 2300 may include multiple washing course selection buttons for selecting a washing method. The dishwashing machine 1 performs washing of tableware in a washing method corresponding to the selected washing course. In particular, the dishwashing machine 1 may determine a washing method, for example, a tableware washing time and an amount of the washing water to be sprayed on the tableware, according to a washing course. At this point, since a tableware washing time and an amount of the washing water to be sprayed on the tableware may be adjusted according to a movement speed of the vane assembly 400, the dishwashing machine 1 may control the movement speed of the vane assembly 400 according to a washing course. Movement speed control of the vane assembly 400 will be described in detail.

As shown in FIG. 21, the washing course selection unit 2300 may include a smart washing button 2310 for inputting an automatic washing course of which the dishwashing machine 1 automatically determines a washing method, a normal washing button 2320 for inputting a normal washing course that performs a predetermined standard washing instruction, a heavy washing button 2330 for inputting a heavy washing method suitable for tableware having a high degree of contamination or a large size, a delicate washing button 2340 for inputting a delicate washing course suitable for tableware including glass and ceramics requiring delicate washing, a quick washing button 2350 for inputting a quick washing method for completing washing at a high speed, a pot washing button 2360 for inputting a pot washing method suitable for tableware including pots and pans, and an eco-washing button 2370 for inputting an eco-washing method that minimizes an amount of the washing water required for washing tableware.

Also, the washing course selection unit 2300 may further include a second indicator 2380 for displaying the selected washing course.

As shown in FIG. 21, the second indicator 2380 may be formed with each selection button as one unit to display a washing course selected by the user. Also, a light emitting element such as an LED lamp that lights up or flickers when the selection button is pressed to display the selected washing course may be employed as the second indicator 2380.

Meanwhile, the washing method may be set differently for each of the washing zones. Hereinafter, with reference to FIG. 22A-D, a washing course setting method regarding each washing zone will be described in detail.

Figure 22A:
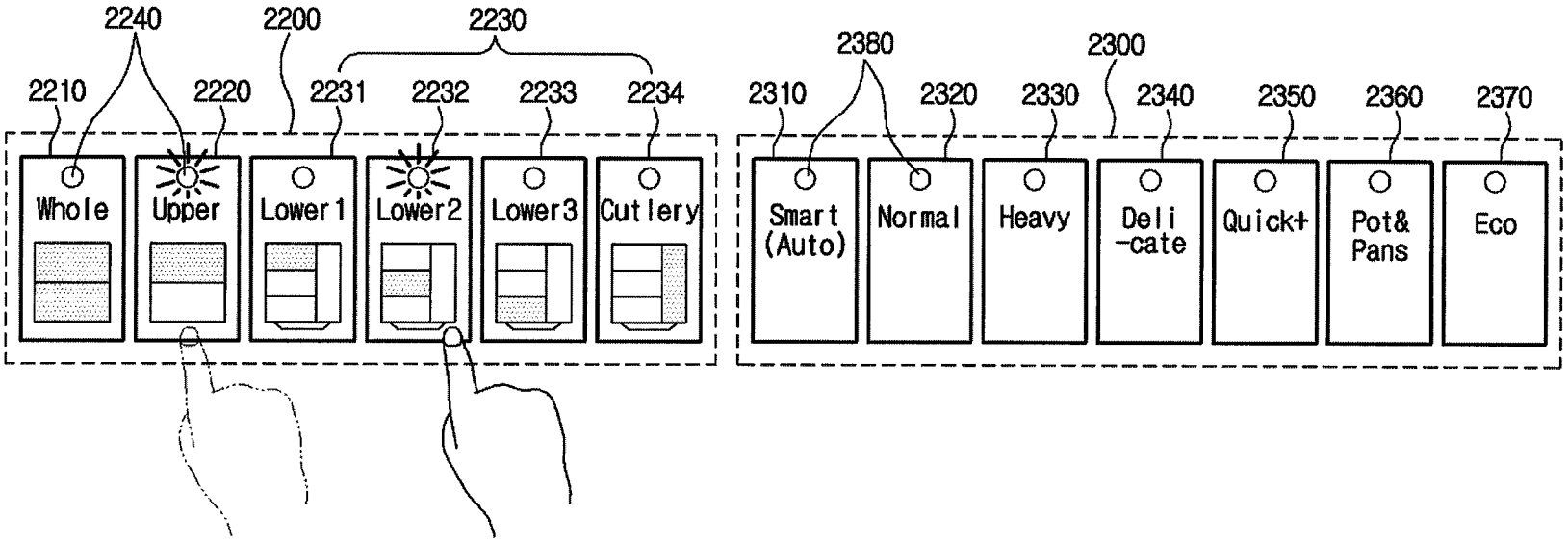
FIG. 22A illustrates a washing zone selection method through the user interface of FIG. 19 according to various embodiments of the present disclosure.
Figure 22B:
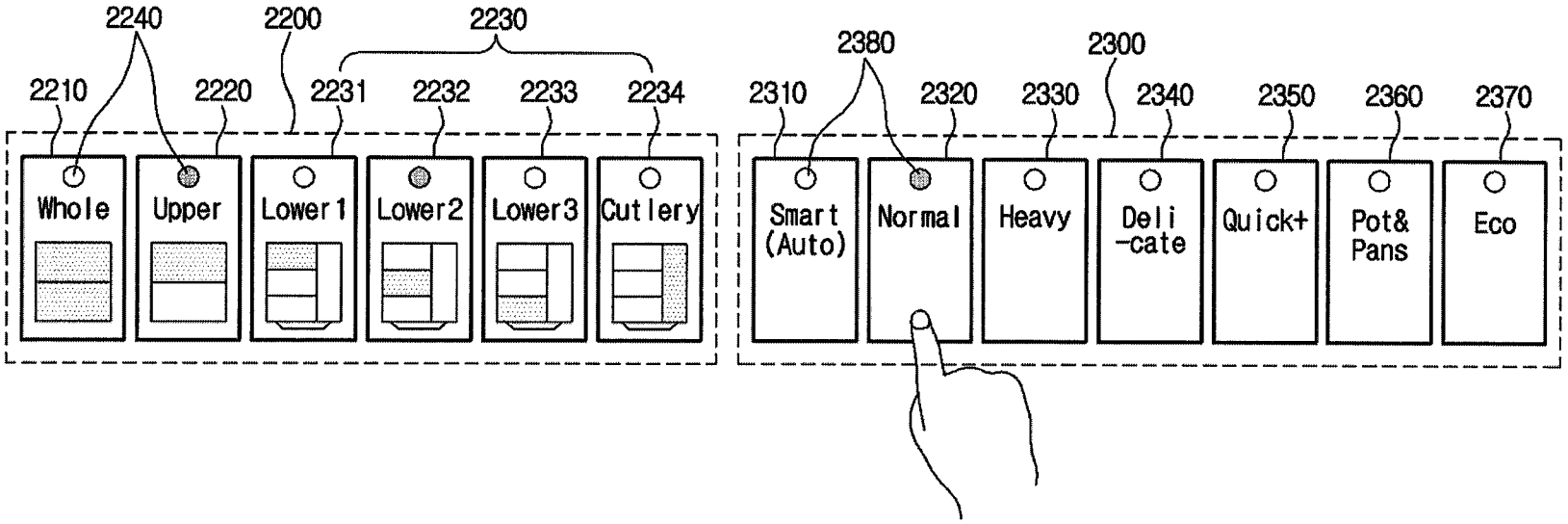
FIG. 22B illustrates a washing course selection method through the user interface of FIG. 19 according to various embodiments of the present disclosure.
Figure 22C:
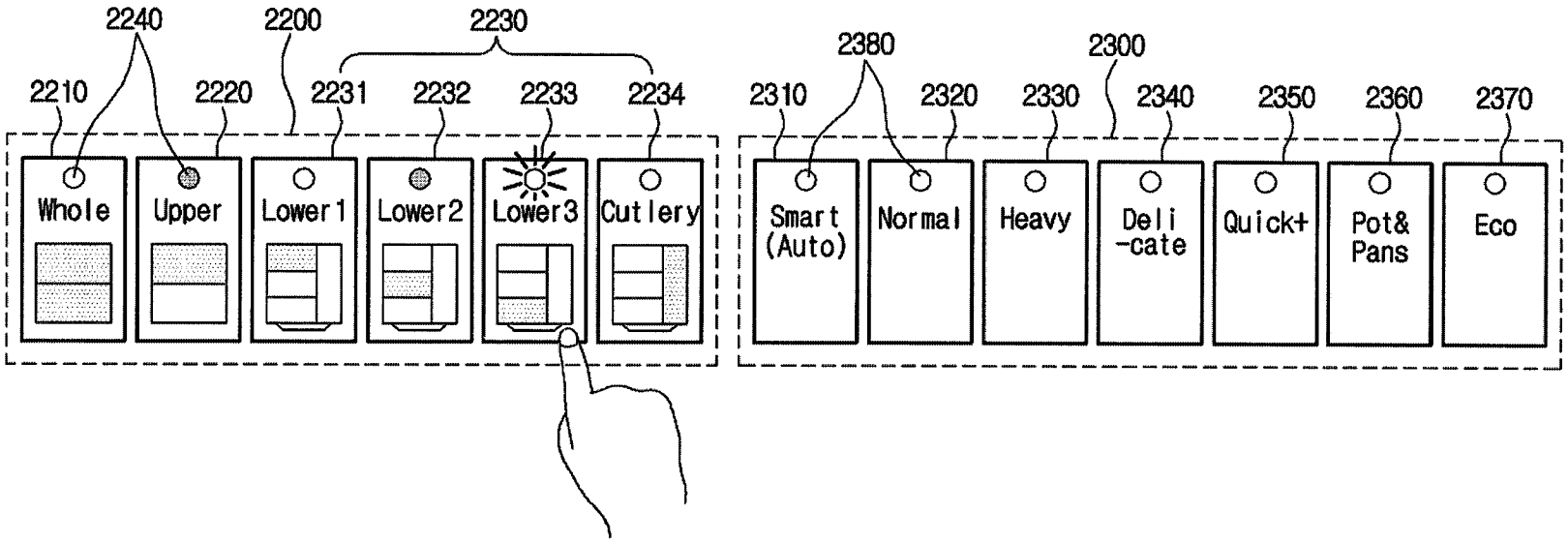
FIG. 22C illustrates an additional washing zone selection method through the user interface of FIG. 19 according to various embodiments of the present disclosure.
Figure 22D:
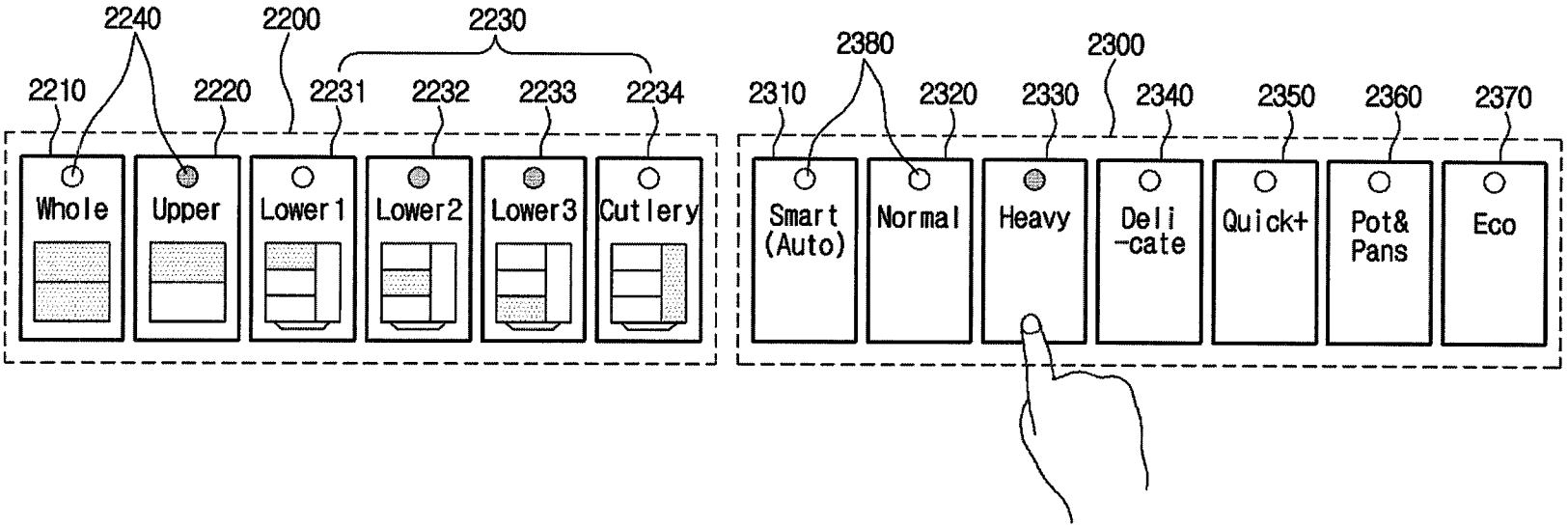
FIG. 22D illustrates a washing course selection method of an additional washing zone through the user interface of FIG. 19 according to various embodiments of the present disclosure.

FIG. 22A is a diagram for explaining a washing zone selection method through the user interface of FIG. 19, FIG. 22B is a diagram for explaining a washing course selection method through the user interface of FIG. 19, FIG. 22C is a diagram for explaining an additional washing zone selection method through the user interface of FIG. 19, and FIG. 22D is a diagram for explaining a washing course selection method of an additional washing zone through the user interface of FIG. 19.

As shown in FIG. 22A, the user may select at least one washing zone to be washed in the divided washing by pressing washing zone buttons included in the washing zone selection unit 2220. For example, the user may select the upper accommodation rack 22*a* and a right center zone of the lower accommodation rack 22*b* as a washing zone in which the divided washing is to be performed by sequentially pressing the upper selection button 2220 and the center selection button 2232.

The dishwashing machine 1 may display a selection of the washing zone by flickering the first indicators 2240 of the selection buttons 2220 and 2232 pressed by the user.

After selecting the washing zone, the user may select a washing method of the selected washing zone by pressing the washing buttons included in the washing course selection unit 2300. With reference to FIG. 22B, the user may select a washing method of the lower accommodation rack 22*a* and the left center zone of the lower accommodation rack 22*b* by pressing the normal washing button 2320.

The dishwashing machine 1 may temporarily store a washing zone and a washing method input by the user.

Also, the dishwashing machine 1 may light up the second indicator 2380 of the normal washing button 2320 pressed by the user to display the selected washing course. At this point, the first indicator 2240 in a flickering state may be also changed to a lit up state to display that selection of the washing zone and the washing course is complete.

The user may select an additional washing zone by pressing the zone selection buttons included in the washing zone selection unit 2200. The additional washing zone may be selected among washing zones which are not selected as the washing zone in FIG. 22A. For example, the user may select a left front zone of the lower accommodation rack 22*b*, which is not selected as the washing zone, by pressing the front selection button 2233.

The dishwashing machine 1 may flicker the first indicator 2240 of the front selection button 2233 to display a selection of the additional washing zone. Also, the dishwashing machine 1 may turn off the second indicator 2380 to inform the user that a washing course can be selected.

After selecting the additional washing zone, the user may select a washing method of the selected additional washing zone by pressing the washing buttons included in the washing course selection unit 2300. With reference to FIG. 22D, the user may select a washing method of the left front zone of the lower accommodation rack 22*b* by pressing the heavy washing button 2330.

The dishwashing machine 1 may store the additional washing zone and the washing method thereof.

Also, the dishwashing machine 1 may light up the second indicator 2380 of the heavy washing button 2330 pressed by the user to display the selected washing course. At this point, the first indicator 2240 in a flickering state may also be changed to a lit up state to display that selection of the additional washing zone and the washing course is complete.

The dishwashing machine 1 may control the lighting and flickering of the first and second indicators 2240 and 2380 to receive the user input regarding a washing course of each of the washing zones. The user may continuously add an additional washing zone and a washing course thereof by repeating the procedures shown in FIGS. 22C and 22D.

When the user presses the washing start button 2700 shown in FIG. 19, the dishwashing machine 1 may perform a stored washing course and washing according to the stored washing course.

In particular, the dishwashing machine 1 may wash the front and rear zones in the divided washing by controlling the movement position of the vane assembly 400, and the upper, lower, left, and right zones in the divided washing by controlling a distribution of the washing water.

Figure 23:
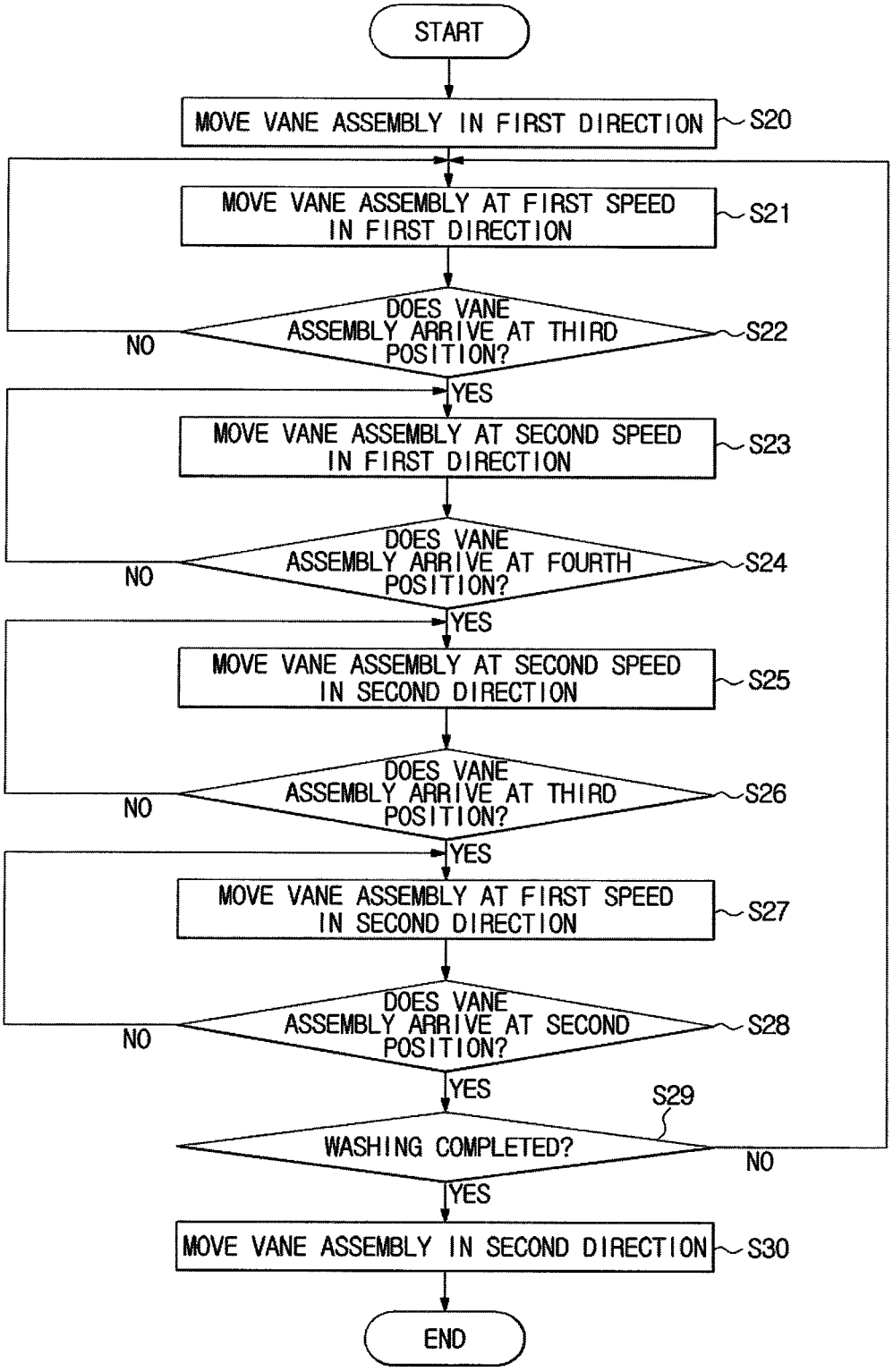
FIG. 23 illustrates the divided washing according to the divided washing instruction according to various embodiments of the present disclosure.
Figure 24:
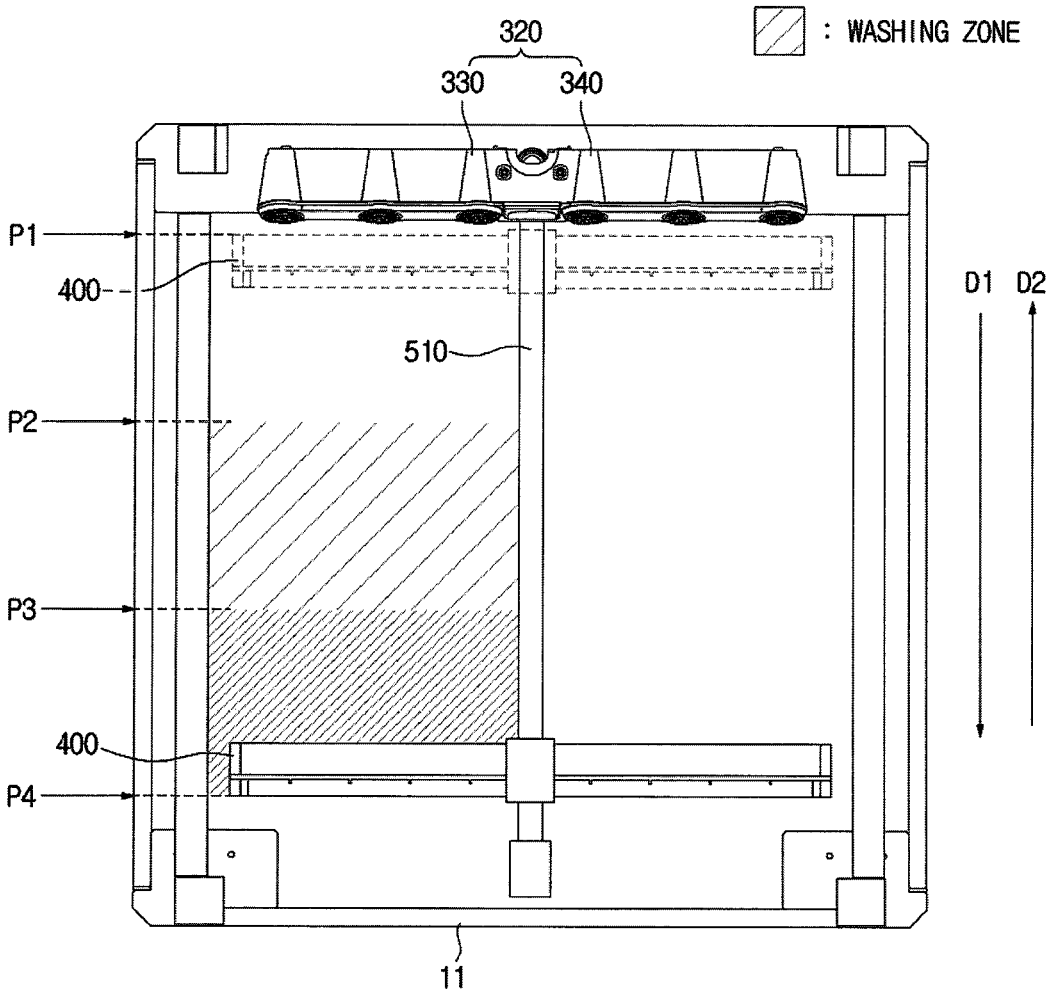
FIG. 24 illustrates movement of the vane assembly during the divided washing of FIG. 23 according to various embodiments of the present disclosure.

Hereinafter, with reference to FIGS. 23 and 24, movement of the vane assembly when the divided washing instruction shown in FIG. 23 is input will be described in detail.

FIG. 23 is a flow chart for explaining another embodiment of the divided washing according to the divided washing instruction. FIG. 24 is a diagram for explaining movement of the vane assembly during the divided washing of FIG. 23.

With reference to FIG. 23, the dishwashing machine 1 moves the vane assembly 400 to the second position P2 (S20). Then, the dishwashing machine 1 moves the vane assembly 400 at a first speed in the first direction D1 (S21). The dishwashing machine 1 may control the rotational speed of the vane drive motor 520 shown in FIG. 7 to enable the vane assembly 400 to move at the first speed.

The first speed may be determined by the washing course of the left center zone. According to the washing course, a washing method, for example, a tableware washing time or an amount of the washing water to be sprayed on the tableware, is determined.

In particular, a tableware washing time during which the washing water is sprayed is reduced when a movement speed of the vane assembly 400 moving in the washing zone is increased, and the tableware washing time is increased when the movement speed of the vane assembly 400 is reduced. That is, the tableware washing time is in proportion to the movement speed of the vane assembly 400. Therefore, the dishwashing machine 1 may determine the tableware washing time according to the washing course set for the washing zone, and then the first speed based on the determined tableware washing time.

Also, when the movement speed of the vane assembly 400 is increased, an amount of the washing water being sprayed on the tableware during a single movement of the vane assembly 400 is increased, whereas the amount of washing water during the single movement is decreased when the movement speed of the vane assembly 400 is decreased. That is, the amount of washing water being sprayed on the tableware is in proportion to the movement speed of the vane assembly 400. Therefore, the dishwashing machine 1 may determine the amount of washing water sprayed in the washing zone according to the washing course set for the washing zone, and then the first speed based on the determined amount of washing water sprayed.

The dishwashing machine 1 determines whether or not the vane assembly 400 arrives at the third position P3. If the vane assembly 400 arrives at the third position P3 (YES in S22), the dishwashing machine 1 moves the vane assembly 400 at a second speed in the first direction D1 (S23). The dishwashing machine 1 may control the rotational speed of the vane drive motor 520 to enable the vane assembly 400 to move at the second speed.

Since the second speed is determined according to the washing course of the left front zone corresponding to the third and fourth positions P3 and P4, the first speed and the second speed may be different from each other if the washing course of the left center zone is different from that of the left front zone.

For example, when the normal washing course is set for the left center zone and the heavy washing course is set for the left front zone, the second speed may be set to be slower than the first speed. The heavy washing course is a course to be selected when the tableware has a high degree of contamination or a large size which may require a greater amount of the sprayed washing water in comparison with the normal washing course. Therefore, the dishwashing machine 1 may set the second speed slower than the first speed to spray a greater amount of the washing water in the left front zone than the left center zone.

If the vane assembly 400 arrives at the fourth position P4 (YES in S24), the dishwashing machine 1 moves the vane assembly 400 at the second speed in the second direction D2 (S25). In particular, the dishwashing machine 1 may reverse the rotational direction of the vane drive motor 520 shown in FIG. 7 to enable the vane assembly 400 to move in the second direction D2.

Thereafter, the dishwashing machine 1 determines whether or not the vane assembly 400 arrives at the third position P3 (S26). If the vane assembly 400 arrives at the third position P3 (YES in S26), the dishwashing machine 1 moves the vane assembly 400 at the first speed in the second direction D2 (S27). That is, since the washing zone is changed from the left front zone to the left rear zone centering on the third position P3, the movement speed of the vane assembly 400 is altered from the second speed to the first speed.

The dishwashing machine 1 determines whether or not the vane assembly 400 arrives at the second position P2 (S28). If the vane assembly 400 arrives at the second position P2 (YES in S28), the dishwashing machine 1 may determine whether or not the washing is completed (S29).

If the washing is completed (YES in S29), the dishwashing machine 1 may move the vane assembly 400 to the first position P1 (S30) and then terminate the washing.

Otherwise, if the washing is not completed (NO in S29), the dishwashing machine 1 returns to S21 to continue the washing of the tableware.

Although it is described in FIG. 19 that washing of the upper accommodation rack 22*a* is not divided, the upper accommodation rack 22*a* may be subdivided into multiple washing zones. For this purpose, at least one nozzle of the upper nozzle 311 and the center nozzle 315 may be substituted with a coupling structure of a fixed type nozzle, a vane assembly, and a vane drive assembly, such as the fixed nozzle provided in the lower portion.

Hereinafter, a variety of exemplary modifications of the washing zone selection unit will be described in detail.

Figure 25:
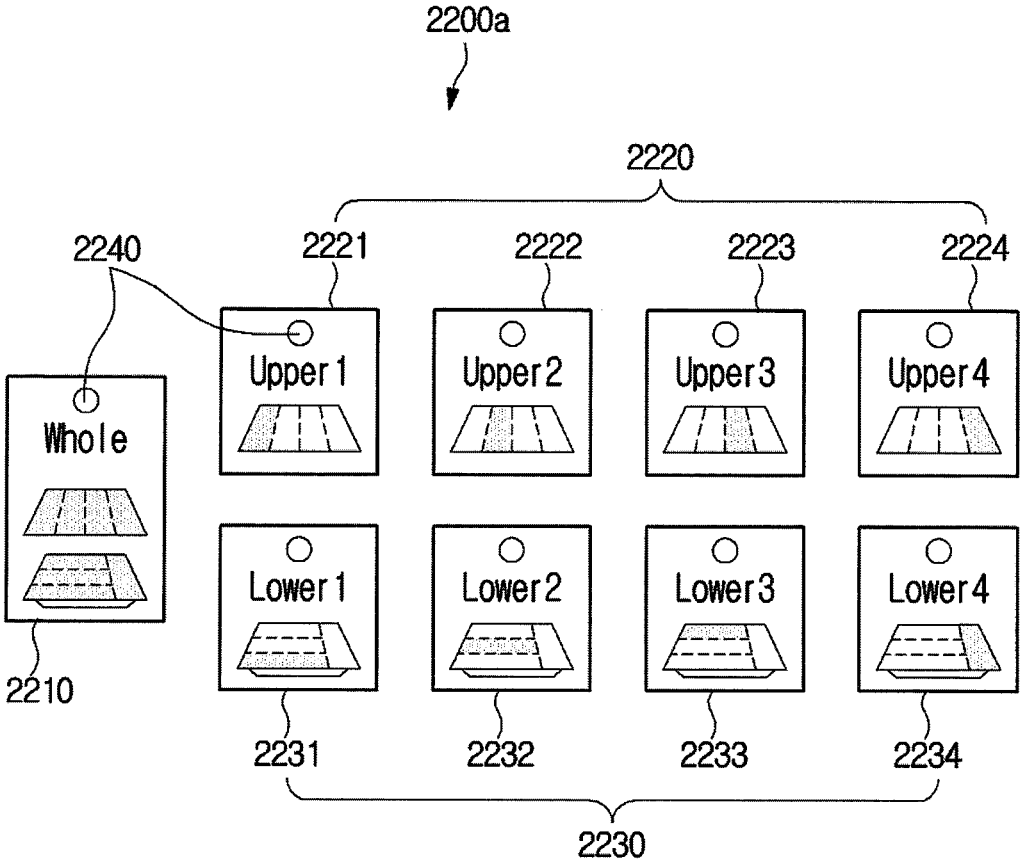
FIG. 25 illustrates the washing zone selection unit of FIG. 19 according to various embodiments of the present disclosure.

FIG. 25 is a diagram illustrating another embodiment of the washing zone selection unit of FIG. 19.

With reference to FIG. 25, the washing zone selection unit 2200*a* includes the select all button 2210 for selecting both of the upper and lower accommodation racks 22*a* and 22*b*, the upper end selection button 2220 for performing the divided washing on the upper accommodation rack 22*a* provided on the upper end of the tub 30, the lower end selection button 2230 for performing the divided washing on the lower accommodation rack 22*b* provided on the lower end of the tub 30, and the first indicator 2240.

The washing zone of the upper accommodation rack 22*a* may be divided into four zones in the left and right directions.

When the washing zone of the upper accommodation rack 22*a* is divided in the left and right directions, the upper selection button 2220 may include a first selection button 2221 for performing the divided washing on tableware stored in a first washing zone at the leftmost side of the upper accommodation rack 22*a*, a second selection button 2222 for performing the divided washing on tableware stored in a second washing zone to the right of the first washing zone, a third selection button 2223 for performing the divided washing on tableware stored in a third washing zone to the right of the second washing zone, and a fourth selection button 2224 for performing the divided washing on tableware stored in a fourth washing zone to the right of the third washing zone.

In addition, the lower selection button 2230 may include the rear selection button 2231 for performing the divided washing on tableware stored in the left rear zone of the lower accommodation rack 22*b*, the center selection button 2232 for performing the divided washing on tableware stored in the left center zone of the lower accommodation rack 22*b*, the front selection button 2233 for performing the divided washing on tableware stored in the left front zone of the lower accommodation rack 22*b*, and the right selection button 2234 for performing the divided washing on tableware stored in the right zone of the lower accommodation rack 22*b*.

At this time, since the upper selection button 2220 is disposed above the lower selection button 2230, and the select all button 2210 is provided in a size larger than those of the upper and lower selection buttons 2220 and 2230, the user may intuitively select the washing zone.

Also, to enable the user to intuitively select the washing zone, a representation of a washing zone to be selected by a button selection may be displayed on a surface of each button 2210, 2220, and 2230.

Although it is described in FIG. 19 that the lower accommodation rack 22*b* is divided into four washing zones, it should be understood that other methods for dividing the washing zone may be used.

Figure 26:
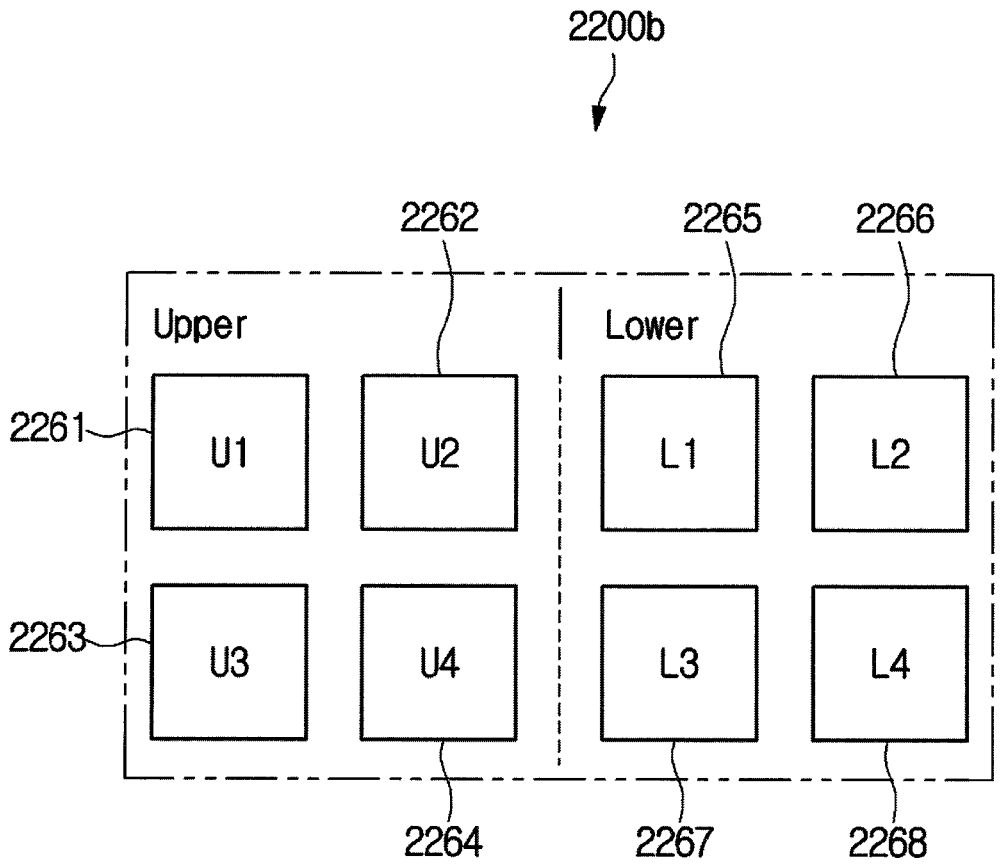
FIG. 26 illustrates the washing zone selection unit of FIG. 19 according to various embodiments of the present disclosure.
Figure 27:
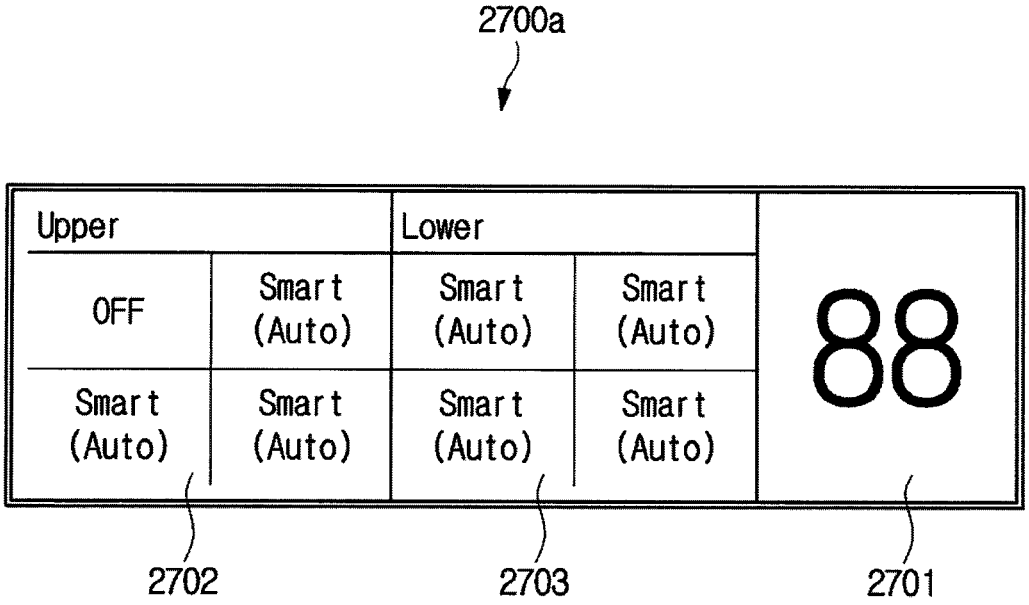
FIG. 27 illustrates a display according to various embodiments of the present disclosure.

FIG. 26 is a diagram illustrating still another embodiment of the washing zone selection unit of FIG. 19. FIG. 27 is a diagram illustrating another embodiment of the display.

For example, the washing zone may be divided into four washing zones in front, rear, left and right directions.

As shown in FIG. 26, when the washing zone is divided in front, rear, left and right directions, a washing zone selection unit 2200*b* may include a first button 2261 for performing the divided washing on tableware stored in a right rear zone U1 of the upper accommodation rack 22*a*, a second button 2262 for performing the divided washing on tableware stored in a left rear zone U2 of the upper accommodation rack 22*a*, a third button 2263 for performing the divided washing on tableware stored in a right front zone U3 of the upper accommodation rack 22*a*, and a fourth button 2264 for performing the divided washing on tableware stored in a left front zone U4 of the upper accommodation rack 22*a*.

In addition, the washing zone selection unit 2200*b* may include a fifth button 2265 for performing the divided washing on tableware stored in a right rear L1 of the lower accommodation rack 22*b*, a sixth button 2266 for performing the divided washing on tableware stored in a left rear L2 of the lower accommodation rack 22*b*, a seventh button 2267 for performing the divided washing on tableware stored in a right front L3 of the lower accommodation rack 22*b*, and an eighth button 2268 for performing the divided washing on tableware stored in a left front L4 of the lower accommodation rack 22*b*.

Although it is described in FIGS. 21 and 22 that the first indicator 2240 displays the selected washing zone and the second indicator 2380 displays the selected washing course, a display 2700*a* may display the selected washing zone and the selected washing course regarding each washing zone.

In particular, the display 2700*a* may include a time display region 2701 representing a washing time, an upper display region 2702 representing a washing zone and a washing course of the upper accommodation rack 22*a*, and a lower display region 2703 representing a washing zone and a washing course of the lower accommodation rack 22*b*.

At this time, the upper display region 2702 may be divided to correspond to each washing zone of the upper accommodation rack 22*a*, thereby representing a selection status or a selected washing course of each washing zone.

Similarly, the lower display region 2703 may be divided to correspond to each washing zone of the lower accommodation rack 22*b*, thereby representing a selection status or a selected washing course of each washing zone.

Figure 28:
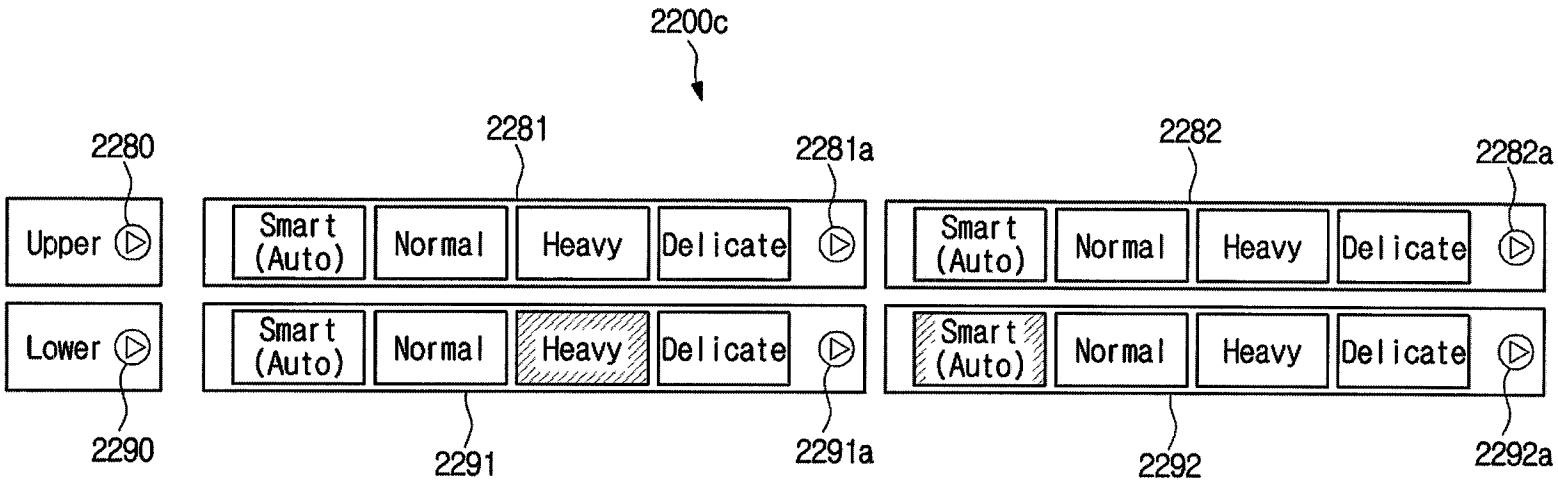
FIG. 28 illustrates the washing zone selection unit and the washing course selection unit according to various embodiments of the present disclosure.

FIG. 28 is a diagram illustrating another embodiment of the washing zone selection unit and the washing course selection unit.

With reference to FIG. 28, the washing zone selection unit 2200*c* may perform functions of the washing course selection unit simultaneously.

In particular, the washing zone selection unit 2200*c* may include an upper selection button 2280 for selecting the upper accommodation rack 22*a*, and a lower selection button 2290 for selecting the lower accommodation rack 22*b*.

In addition, the washing zone selection unit 2200*c* may include a first display region 2281 representing a washing course of the left zone of the upper accommodation rack 22*a*, a second display region 2282 representing a washing course of the right zone of the upper accommodation rack 22*a*, a third display region 2291 representing a washing course of the left zone of the lower accommodation rack 22*b*, and a fourth display region 2292 representing a washing course of the right zone of the lower accommodation rack 22*b*.

A first region button 2281 a for selecting divided washing of the left zone of the upper accommodation rack 22*a* and a washing course thereof may be provided on one side of the first display region 2281.

When the first region button 2281*a* is pressed once, the left zone of the upper accommodation rack 22*a* is selected as a washing zone. Also, according to the numbers of times the first region button 2281 a is pressed, a washing method of the left zone of the upper accommodation rack 22*a* may be selected.

For example, when the first region button 2281*a* is pressed once, an automatic washing course is selected, when the first region button 2281*a* is pressed a second time, a normal washing course is selected, when the first region button 2281*a* is pressed a third time, a heavy washing course is selected, and when the first region button 2281*a* is pressed a fourth time, a delicate washing course is selected.

Further, if the washing course is changed according to the pressing of the first region button 2281*a*, the first display region 2281 may display a zone corresponding to the changed washing course.

In addition, a second region button 2282*a* may be provided on one side of the second display region 2282 for selecting a divided washing selection of the left zone of the upper accommodation rack 22*a* and a washing course thereof, a third region button 2291*a* may be provided on one side of the third display region 2291 for selecting a divided washing selection of the left zone of the lower accommodation rack 22*b* and a washing course thereof, and a fourth region button 2292*a* may be provided on one side of the fourth display region 2292 for selecting a divided washing selection of the right zone of the lower accommodation rack 22*b* and a washing course thereof.

Meanwhile, the user interface 600 may be implemented as a touch screen. Hereinafter, with reference to FIGS. 29 to 33, methods for selecting a washing zone and selecting a washing course when the user interface 600 is implemented as a touch screen will be described in detail.

Figure 29:
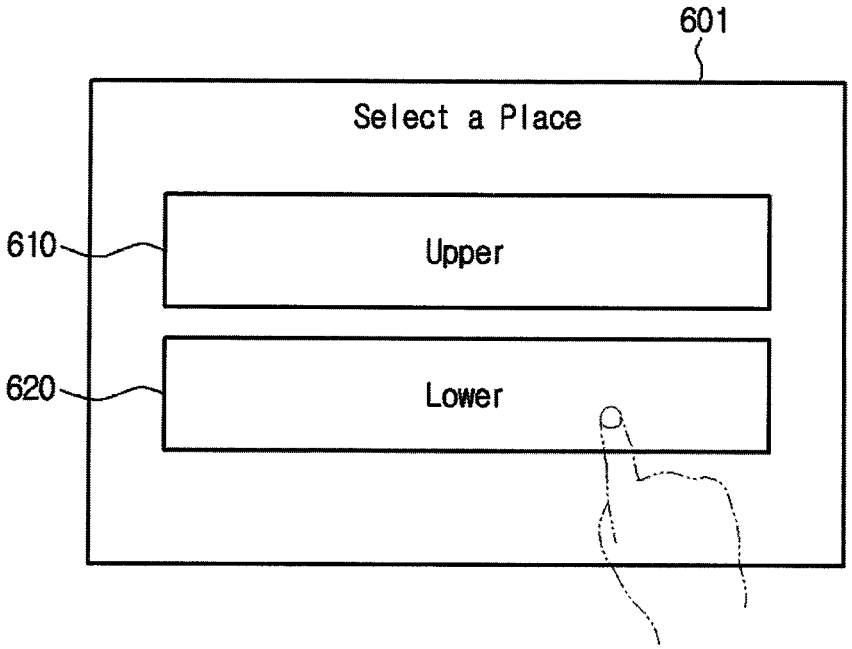
FIG. 29 illustrates a main screen of the user interface for inputting the divided washing instruction according to various embodiments of the present disclosure.
Figure 30:
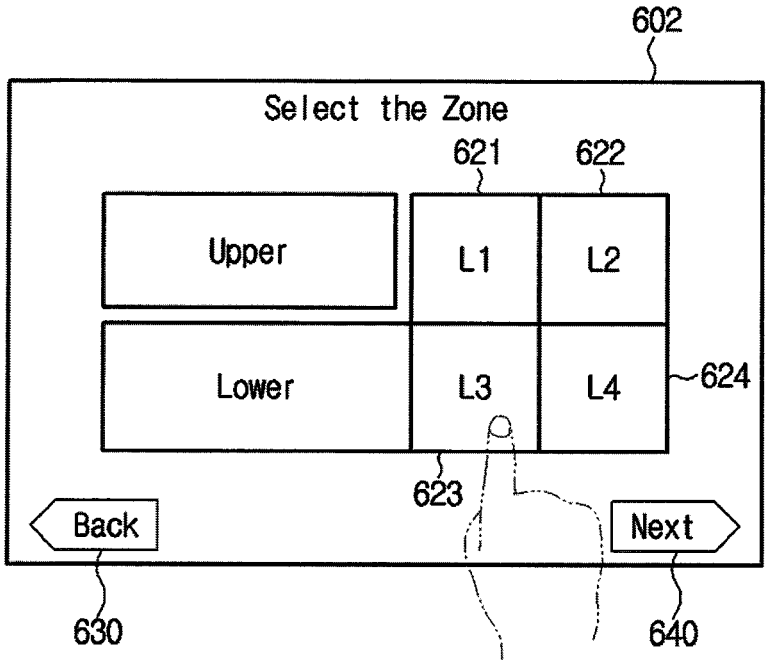
FIG. 30 illustrates a zone selection screen of the user interface for inputting the divided washing instruction according to various embodiments of the present disclosure.
Figure 31:
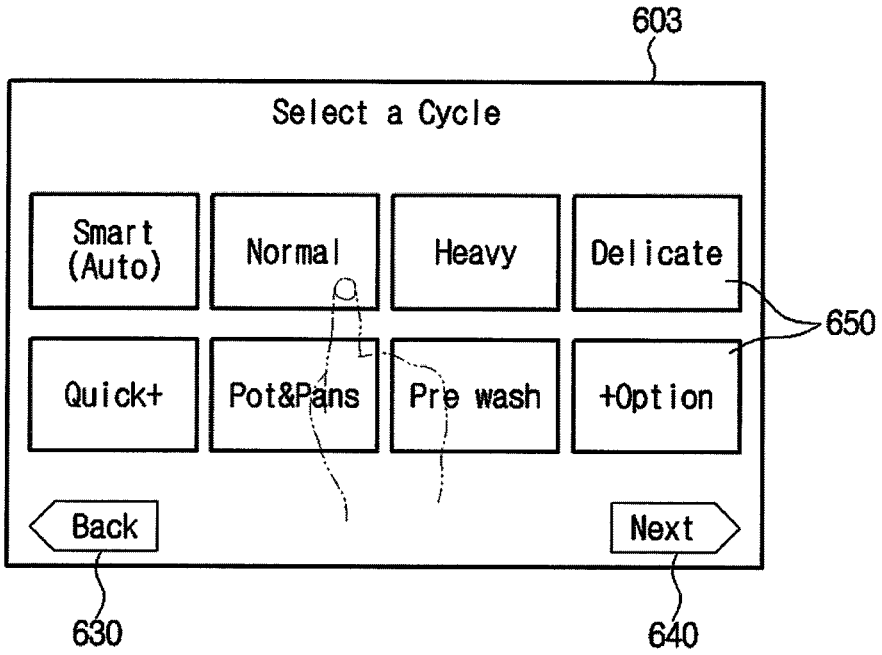
FIG. 31 illustrates a washing course selection screen of the user interface for inputting the divided washing instruction according to various embodiments of the present disclosure.
Figure 32:
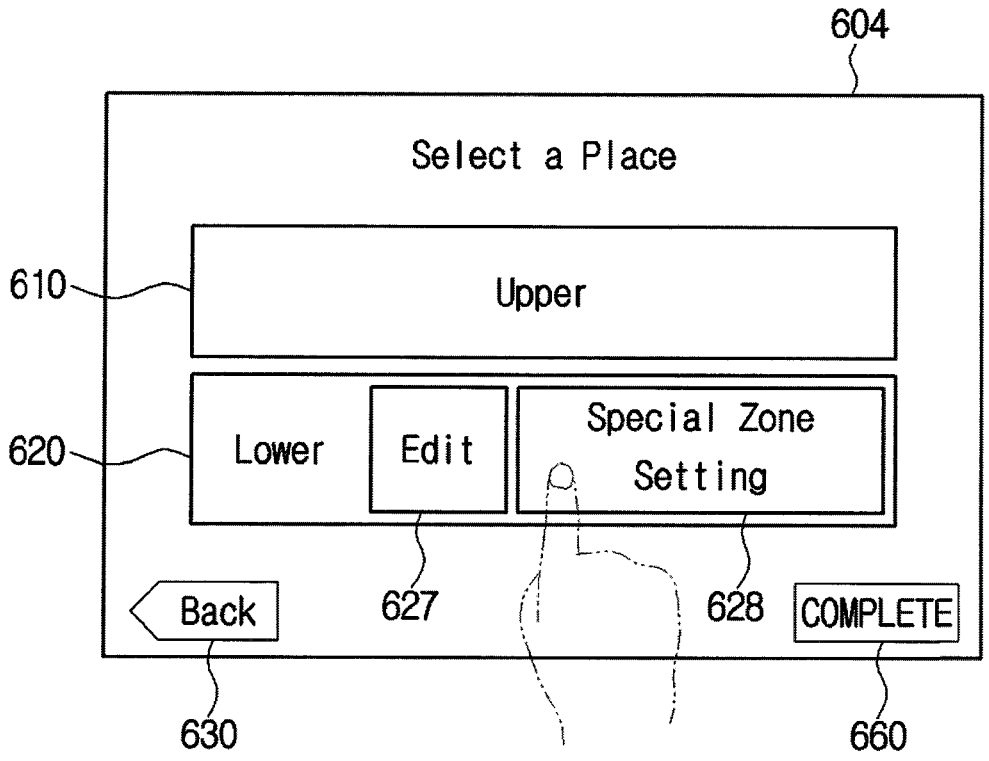
FIG. 32 illustrates a setting screen of the user interface for inputting the divided washing instruction according to various embodiments of the present disclosure.
Figure 33:
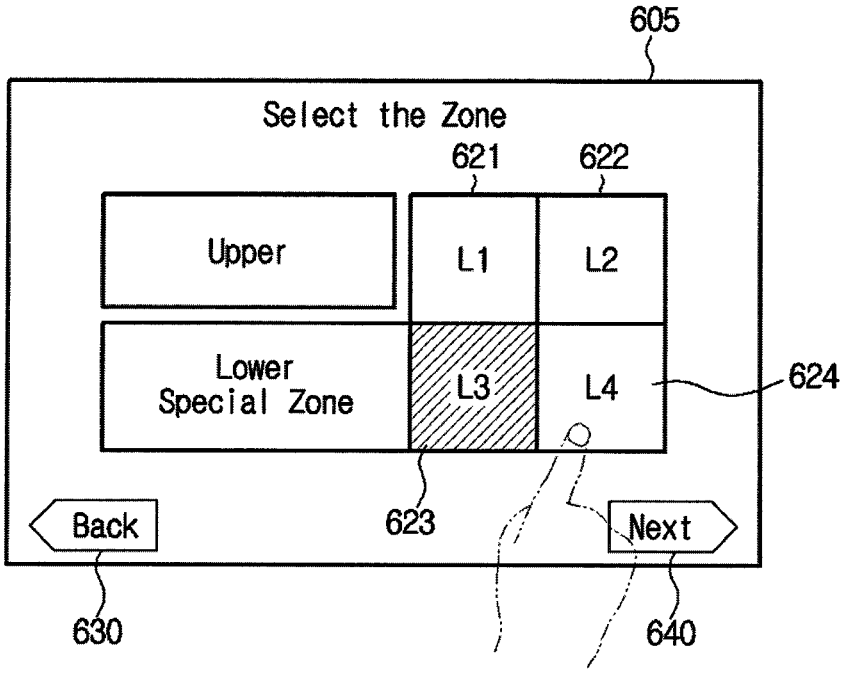
FIG. 33 illustrates an additional zone selection screen of the user interface for inputting the divided washing instruction according to various embodiments of the present disclosure.

FIG. 29 is a diagram illustrating a main screen of the user interface for inputting the divided washing instruction, FIG. 30 is a diagram illustrating a zone selection screen of the user interface for inputting the divided washing instruction, FIG. 31 is a diagram illustrating a washing course selection screen of the user interface for inputting the divided washing instruction, FIG. 32 is a diagram illustrating a setting screen of the user interface for inputting the divided washing instruction, and FIG. 33 is a diagram illustrating an additional zone selection screen of the user interface for inputting the divided washing instruction.

When the dishwashing machine 1 is powered on, the user interface 600 may display a main screen 601 like that shown in FIG. 29.

The main screen 601 includes an upper selection icon 610 for selecting a washing zone of the upper accommodation rack 22*a*, and a lower selection icon 620 for selecting a washing zone of the lower accommodation rack 22*b*.

The user interface 600 may display an upper zone selection screen for selecting a washing zone of the upper accommodation rack 22*a* when the upper selection icon 610 is selected, and a lower zone selection screen for selecting a washing zone of the lower accommodation rack 22*b* when the lower selection icon 620 is selected.

For example, when the lower selection icon 620 is selected, the user interface 600 may display a zone selection screen 602 like that shown in FIG. 30.

The zone selection screen 602 may include zone selection icons 621, 622, 623, and 624, a back icon 630 for returning to the main screen, and a next icon 640 for changing to a washing course selection screen.

In particular, the zone selection screen 602 may include a first zone icon 621 for performing the divided washing on tableware stored in the right rear L1 of the lower accommodation rack 22*b*, a second zone icon 622 for performing the divided washing on tableware stored in the left rear L2 of the lower accommodation rack 22*b*, a third zone icon 623 for performing the divided washing on tableware stored in the right front L3 of the lower accommodation rack 22*b*, and a fourth zone icon 624 for performing the divided washing on tableware stored in the left front L4 of the lower accommodation rack 22*b*.

A shape of each of the zone icons 621, 622, 623, and 624 may be corresponded to a shape of a washing zone to which the divided washing is applicable, and the zone icons 621, 622, 623, and 624 may be arranged according to the positions of the washing zones.

The user may touch at least one of the zone icons 621, 622, 623, and 624 to select a washing zone on which the divided washing is to be performed.

When the user selects the next icon 640, the user interface 600 displays a washing course selection screen 603 like that shown in FIG. 31. The washing course selection screen 603 may include icons 650 for selecting a washing course, the back icon 630 for returning to the washing zone selection screen, and the next icon 640 for moving to a setting screen.

The user may select a washing course of the washing zone L3 selected as shown in FIG. 30 by selecting one of the icons 650.

When the user selects the washing course, the dishwashing machine 1 may store the selected washing zone and the washing course thereof.

When the user selects the next icon 640, the user interface 600 displays thereon a setting screen 604 like that shown in FIG. 32.

The setting screen may display an edit icon 627 for changing the selected washing zone and the washing course thereof, an additional setting icon 628 for selecting an additional washing zone, and a complete icon 660 for terminating the washing zone and washing course setting.

When the user selects the additional setting icon 628, the user interface 600 may display thereon an additional washing zone selection screen 605 as shown in FIG. 33. The additional washing zone selection screen 605 may include the zone icons 612, 622, 623, and 624, the back icon 630 for returning to the setting screen 604, and the next icon 640 for moving to the washing course selection screen 603.

The additional washing zone may be selected only from washing zones that are not selected. For this purpose, the zone icon 623 corresponding to the selected washing zone is not selected even when the user touches it, and the zone icon 623 corresponding to the selected washing zone and the remaining zone ions 621, 622, and 623 may be displayed discriminably.

When the user selects the washing course and then touches the next icon 640, the user interface 600 displays the washing course selection screen 603 as shown in FIG. 31 for enabling the user to select a washing course of the additional washing zone.

When the user selects the washing course and then touches the next icon 640, the dishwashing machine 1 may store the selected additional washing zone and the washing course thereof.

Once all instructions for performing the divided washing are input as described above, the dishwashing machine 1 may perform the divided washing according to the divided washing instruction input through the user interface 600.

Although the present disclosure has been described with an exemplary embodiment, various changes and modifications may be suggested to one skilled in the art. It is intended that the present disclosure encompass such changes and modifications as fall within the scope of the appended claims.

What is claimed is:

1. A dishwashing machine, comprising:

a tub configured to accommodate tableware;

a nozzle assembly including a plurality of nozzles each configured to spray washing water toward a vane assembly that is separate from the nozzle assembly, the plurality of nozzles including a first nozzle and a second nozzle;

a distribution valve configured to control a supply of the washing water to the first nozzle and the second nozzle;

the vane assembly, configured to:

move linearly inside the tub, and deflect the washing water from the nozzle changing a traveling direction of the washing water toward the tableware in the tub;

a user interface configured to receive a divided washing zone selected by a user, the divided washing zone being one of a first washing zone and a second washing zone; and a control unit configured to:

determine a linear movement range of the vane assembly according to the divided washing zone, control a movement speed of the vane assembly according to a selected washing method for the linear movement range of the divided washing zone to wash the selected divided washing zone with the deflected washing water, based on the user selecting the first washing zone, control the distribution valve to adjust an amount of the washing water distributed through the first nozzle according to the movement speed and the determined linear movement range of the vane assembly for the selected washing method, and based on the user selecting the second washing zone, control the distribution valve to adjust an amount of the washing water distributed through the second nozzle according to the movement speed and the determined linear movement range of the vane assembly for the selected washing method.

2. The dishwashing machine according to claim 1, wherein the user interface includes:

a washing zone selection unit configured to select the divided washing zone; and a washing course selection unit configured to select the washing method of the divided washing zone.

3. The dishwashing machine according to claim 2, wherein the user interface is configured to display a zone selection screen for selecting the divided washing zone.

4. The dishwashing machine according to claim 3, wherein the user interface is configured to display a washing course selection screen for determining the washing method of the selected divided washing zone after selecting the divided washing zone.

5. The dishwashing machine according to claim 3, wherein the zone selection screen is configured to discriminate a predetermined divided washing zone from a selectable divided washing zone to display the predetermined divided washing zone and the selectable divided washing zone.

6. The dishwashing machine according to claim 2, wherein the control unit is configured to:

control the nozzle assembly to not spray washing water toward the tableware in the tub.

7. The dishwashing machine according to claim 6, wherein the control unit is configured to control a spray pressure of the washing water according to the selected washing method of the divided washing zone.

8. The dishwashing machine according to claim 2, wherein the washing method is set differently for each of the divided washing zones.

9. The dishwashing machine according to claim 2, wherein the washing zone selection unit includes a first indicator configured to display selected divided washing zones among the divided washing zones.

10. The dishwashing machine according to claim 2, wherein the washing course selection unit includes a second indicator configured to display a washing method selected from a plurality of washing methods.

11. The dishwashing machine according to claim 2, wherein the user interface further includes a display configured to display a washing course set for each of the divided washing zones.

12. The dishwashing machine according to claim 2, wherein:

the nozzle assembly is fixed, and the control unit is configured to control the amount of the washing water distributed through the plurality of nozzles corresponding to the divided washing zone among the nozzles.

13. A method of controlling a dishwashing machine, which includes a tub configured to accommodate tableware, a nozzle assembly that is fixed and immovably fastened to the tub, includes a plurality of nozzles, the plurality of nozzles including a first nozzle and a second nozzle, and the nozzle assembly is configured to not spray washing water toward the tableware in the tub, a distribution valve configured to control a supply of the washing water to the first nozzle and the second nozzle, a vane assembly configured to change a traveling direction of the washing water sprayed from the nozzle assembly and to move linearly inside the tub, and a user interface, the method comprising:

setting a divided washing zone to be washed by receiving a divided washing zone input by a user through the user interface, the divided washing zone being one of a first washing zone and a second washing zone;

determining a linear movement range of the vane assembly according to the divided washing zone;

controlling a movement speed of the vane assembly according to a selected washing method for the linear movement range of the divided washing zone input;

based on the user selecting the first washing zone, controlling the distribution valve to adjust an amount of washing water distributed through the first nozzle according to the movement speed and the determined linear movement range of the vane assembly for the selected washing method; and based on the user selecting the second washing zone, controlling the distribution valve to adjust an amount of washing water distributed through the second nozzle according to the movement speed and the determined linear movement range of the vane assembly for the selected washing method, wherein a control unit is configured to control a movement of the vane assembly and the amount of washing water distributed through the plurality of nozzles.

14. The method according to claim 13, wherein the setting includes selecting the washing method of the divided washing zone input.

15. The method according to claim 14, wherein the setting includes displaying the selected washing method among a plurality of washing methods.

16. The method according to claim 13, wherein the setting includes displaying the divided washing zone input among a plurality of washing zones.

17. The method according to claim 14, wherein distributing the washing water includes:

distributing the washing water according to the divided washing zone and the washing method; and controlling movement of the vane assembly according to the divided washing zone and the washing method.

18. The method according to claim 13, wherein the setting includes displaying a zone selection screen for selecting the divided washing zone.

19. The method according to claim 18, wherein the setting includes displaying a washing course selection screen for determining a washing method of a washing zone after the divided washing zone is selected.

20. The method according to claim 16, wherein the setting includes displaying a washing course selected with respect to each of the divided washing zones.

* * * * *